United States Patent [19]

Misumi et al.

[11] Patent Number: 4,490,454

[45] Date of Patent: Dec. 25, 1984

[54] PHOTOCONDUCTIVE MEMBER COMPRISING MULTIPLE AMORPHOUS LAYERS

[75] Inventors: Teruo Misumi, Kawasaki; Kyosuke Ogawa, Sakurashin; Junichiro Kanbe, Yokohama; Keishi Saitoh, Yokohama; Yoichi Osato, Yokohama; Shigeru Shirai, Yamato, all of Japan

[73] Assignee: Canon Kabushiki Kaisha, Tokyo, Japan

[21] Appl. No.: 475,250

[22] Filed: Mar. 14, 1983

[30] Foreign Application Priority Data

| | | | |
|---|---|---|---|
| Mar. 17, 1982 | [JP] | Japan | 57-42400 |
| Mar. 17, 1982 | [JP] | Japan | 57-42401 |
| Mar. 17, 1982 | [JP] | Japan | 57-42402 |
| Mar. 17, 1982 | [JP] | Japan | 57-42403 |

[51] Int. Cl.[3] ..... G03C 5/08; G03C 5/14

[52] U.S. Cl. ..... 430/84; 252/501.1; 357/2; 427/74; 430/57; 430/95

[58] Field of Search ..... 430/57, 84, 95; 252/501.1; 427/74; 357/2

[56] References Cited

U.S. PATENT DOCUMENTS

| | | | |
|---|---|---|---|
| 4,365,107 | 12/1982 | Yamauchi | 427/39 X |
| 4,377,628 | 3/1983 | Ishioka et al. | 430/64 |
| 4,394,425 | 7/1983 | Shimizu et al. | 430/66 X |
| 4,394,426 | 7/1983 | Shimizu et al. | 430/66 X |
| 4,414,319 | 11/1983 | Shirai et al. | 430/65 |
| 4,460,669 | 7/1984 | Ogawa et al. | 430/95 X |
| 4,460,670 | 7/1984 | Ogawa et al. | 430/57 |

*Primary Examiner*—John E. Kittle
*Assistant Examiner*—Mukund J. Shah
*Attorney, Agent, or Firm*—Fitzpatrick, Cella, Harper & Scinto

[57] ABSTRACT

A photoconductive member comprises a support for photoconductive member and an amorphous layer comprising an amorphous material containing silicon atoms as a matrix and exhibiting photoconductivity, said amorphous layer having a first layer region containing, as constituent atoms, oxygen atoms and a second layer region containing, as constituent atoms, the atoms belonging to the group V of the periodic table in a distribution which is continuous in the direction of the layer thickness and more enriched toward the side of said support.

45 Claims, 13 Drawing Figures

PHOTOCONDUCTIVE MEMBER COMPRISING MULTIPLE AMORPHOUS LAYERS

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays and gamma-rays).

2. Description of the Prior Art

Photoconductive materials, which constitute photoconductive layers in solid state image pick-up devices, in image forming members for electrophotography in the field of image formation, or in manuscript reading devices, are required to have a high sensitivity, a high SN ratio [Photocurrent ($I_p$)/Dark Current ($I_d$)], spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. In particular, in case of an image forming member for electrophotography to be assembled in an electrophotographic device to be used in an office as office apparatus, the aforesaid harmless characteristic is very important.

From the standpoint as mentioned above, amorphous silicon (hereinafter referred to as a-Si) has recently attracted attention as a photoconductive material. For example, German Laid-Open Patent Publication Nos. 2746967 and 2855718 disclose applications of a-Si for use in image forming members for electrophotography, and German Laid-Open Patent Publication No. 2933411 an application of a-Si for use in a photoconverting reading device However, under the present situation, the photoconductive members having photoconductive layers constituted of a-Si are further required to be improved in overall characteristics including electrical, optical and photoconductive characteristics such as dark resistance value, photosensitivity and response to light, etc., and environmental characteristics during use such as humidity resistance, and further stability with lapse of time.

For instance, when applied in an image forming member for electrophotography, residual potential is frequently observed to remain during use thereof if improvements to higher photosensitivity and higher dark resistance are scheduled to be effected at the same time. When such a photoconductive member is repeatedly used for a long time, there will be caused various inconveniences such as accumulation of fatigues by repeated uses or so called ghost phenomenon wherein residual images are formed.

As another disadvantage, for example, according to the experience by the present inventors from a number of experiments, a-Si material constituting the photoconductive layer of an image forming member for electrophotography, while it has a number of advantages as compared with inorganic photoconductive materials such as Se, CdS, ZnO or organic photoconductive materials such as PVCz or TNF of prior art, is also found to have several problems to be solved. Namely, when charging treatment is applied for formation of electrostatic images on the photoconductive layer of an image forming member for electrophotography having a photoconductive member constituted of a mono-layer of a-Si which has been endowed with characteristics for use in a solar battery of prior art, dark decay is markedly rapid, whereby it is difficult to apply a conventional electrophotographic method. This tendency is further pronounced under a humid atmosphere to such an extent in some cases that no charge is retained at all before development.

Further, a-Si materials may contain as constituent atoms hydrogen atoms or halogen atoms such as fluorine atoms, chlorine atoms, etc. for improving their electrical, photoconductive characteristics, boron atoms, phosphorus atoms, etc. for controlling the electroconduction type as well as other atoms for improving other characteristics. Depending on the manner in which these constituent atoms are contained, there may sometimes be caused problems with respect to electrical or photoconductive characteristics of the layer formed That is, for example, in many cases, the life of the photocarriers generated by light irradiation in the photoconductive layer formed is insufficient, or at the dark portion, the charges injected from the support side cannot be sufficiently impeded.

Thus, it is required in designing of a photoconductive material to make efforts to obtain desirable electrical, optical and photoconductive characteristics as mentioned above along with the improvement of a-Si materials per se.

In view of the above points, the present invention contemplates the achievement obtained as a result of extensive studies made comprehensively from the standpoints of applicability and utility of a-Si as a photoconductive member for image forming members for electrophotography, solid state image pick-up devices, reading devices, etc. Now, a photoconductive member having a photoconductive layer which comprises a-Si, particularly an amorphous material containing at least one of hydrogen atom (H) and halogen atom (X) in a matrix of silicon atoms [hereinafter referred to comprehensively as a-Si(H,X)], so called hydrogenated amorphous silicon, halogenated amorphous silicon or halogen-containing hydrogenated amorphous silicon, said photoconductive member being prepared by designing so as to have a specific structure as described later, is found to exhibit not only practically extremely excellent characteristics but also surpass the photoconductive members of the prior art in substantially all respects, especially markedly excellent characteristics as a photoconductive member for electrophotography. The present invention is based on such finding.

SUMMARY OF THE INVENTION

The object of the present invention is to provide an all-environment type photoconductive member having constantly stable electrical, optical and photoconductive characteristics, which are not controlled by the environment under use, being markedly excellent in light fatigue resistance and excellent in durability without causing any deterioration phenomenon after repeated uses and free entirely or substantially from residual potentials observed.

Another object of the present invention is to provide a photoconductive member having excellent electrophotographic characteristics, which is sufficiently capable of retaining charges at the time of charging treatment for formation of electrostatic charges to the extent such that a conventional electrophotographic method can be very effectively applied when it is provided for use as an image forming member for electrophotography.

A further object of the present invention is to provide a photoconductive member for electrophotography capable of providing easily a high quality image which is high in density, clear in halftone and high in resolution.

Still another object of the present invention is to provide a photoconductive member having high photosensitivity, high SN ratio characteristic and good electrical contact with a support.

According to the present invention, there is provided a photoconductive member comprising a support for a photoconductive member and an amorphous layer comprising an amorphous material containing silicon atoms as a matrix and exhibiting photoconductivity, said amorphous layer having a first layer region containing oxygen atoms as constituent atoms and a second layer region containing, as constituent atoms, the atoms belonging to the group V of the periodic table in a distribution which is continuous in the direction of the layer thickness and more enriched toward the side of said support.

DETAILED DESCRIPTION OF THE PREFERRED EMBODIMENTS

Figure 1:
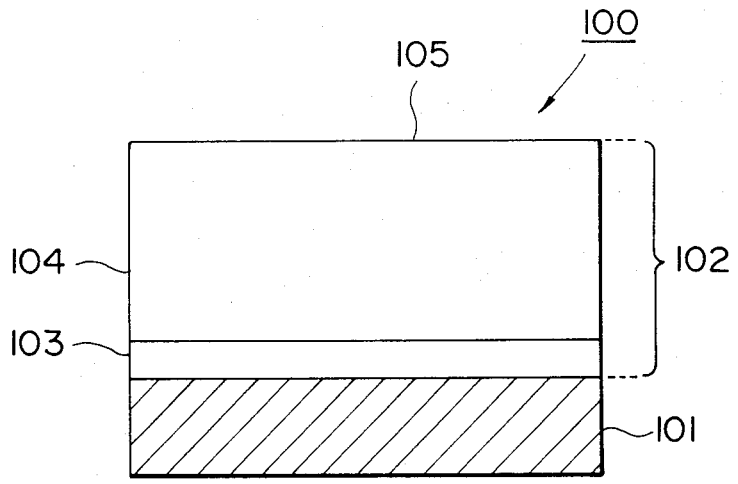
FIG. 1 and FIG. 11 show schematic sectional views for illustration of preferred embodiments of the constitution of the photoconductive member according to the present invention, respectively.

Referring now to the drawings, the photoconductive member of the present invention is to be described in detail.

FIG. 1 shows a schematic sectional view for illustration of a typical exemplary constitution of the photoconductive member of this invention.

The photoconductive member 100 as shown in FIG. 1 has a support 101 for photoconductive member and an amorphous layer 102 comprising a-Si, preferably a-Si(H,X) and exhibiting photoconductivity provided on the support 101, said amorphous layer 102 having a layer region (V) 103 containing as constituent atoms the atoms belonging to the group V of the periodic table (the group V atoms) on the side of the support 101.

The layer region 104 constituting a part of the amorphous layer 102 contains substantially no group V atom.

In the photoconductive member of the present invention, oxygen atoms are contained in the amorphous layer.

The oxygen atoms contained in the amorphous layer in the present invention are contained in the entire layer region of the amorphous layer so that they may form substantially uniform distributions in the direction of the layer thickness and within planes parallel to the surface of the support.

In the photoconductive member according to the present invention, improvements to higher dark resistance and to better adhesion between the amorphous layer and the support on which it is directly provided are intended preponderantly by incorporation of oxygen atoms in the amorphous layer.

The group V atoms to be contained in the layer region (V) are distributed continuously in the direction of the layer thickness and in a distribution such that they are more enriched on the side of the aforesaid support 101 relative to the side opposite to the side on which the aforesaid support is provided (the side of the free surface 105 of the amorphous layer 102 in FIG. 1).

As the atoms belonging to the group V of the periodic table, there may be employed P (phosphorus), As (arsenic), Sb (antimony), Bi (bismuth), particularly preferably P and As.

The distribution state of the aforesaid group V atoms contained in the layer region (V) constituting the amorphous layer is made in the direction of the layer thickness such that they are contained at higher concentration on the support side of the amorphous layer than on the free surface (upper surface) side of the amorphous layer.

On the other hand, the distribution of the group V atoms contained in the layer region (V) is made substantially uniform in the direction parallel to the surface of the support.

FIG. 2 through FIG. 10 show typical examples of the distribution states of the group V atoms contained in the layer region (V) constituting the amorphous layer of the photoconductive member in the present invention.

Oxygen atoms, in case of the present invention, are contained evenly within the whole layer region of the amorphous layer in such a distribution state as mentioned above, and therefore in the following description about the embodiments of FIGS. 2 through 10, the layer region (O) containing oxygen atoms (corresponding to the whole layer region of the amorphous layer) is not referred to unless explanations are specifically required.

In FIG. 2 through FIG. 10, the axis of abscissa shows the content C of the group V atoms, while the axis of ordinate shows the layer thickness of the layer region (V) containing the group V atoms provided in the amorphous layer exhibiting photoconductivity, $t_B$ indicating the position of the interface on the side of the support and $t_T$ the position of the interface on the side opposite to the support side. That is, the layer region (V) containing the group V atoms is formed in the direction from the $t_B$ side toward the $t_T$ side.

In the present invention, the layer region (V) containing the group V atoms comprises a-Si, preferably a-Si(H,X), and it is permitted to be localized on the support side of the amorphous layer exhibiting photo- conductivity.

Figure 2:
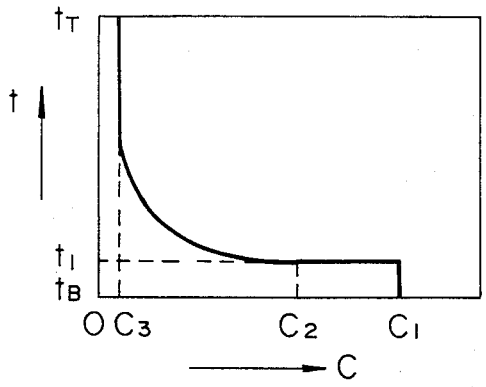
FIG. 2 through FIG. 10 show schematic charts for illustration of the distribution state of the group V atoms in the layer region (V) containing the group V atoms which constitutes the amorphous layer, respectively.

FIG. 2 shows a first typical example of the depth profile of the group V atoms contained in the layer region (V) constituting the amorphous layer in the direction of the layer thickness.

In the embodiment as shown in FIG. 2, from the interface position $t_B$, at which the surface on which the layer region (V) containing the group V atoms is to be formed is contacted with the surface of said layer region (V), to the position of $t_1$, the group V atoms are contained in the layer region (V) with the distribution concentration C of the group V atoms being a constant value of $C_1$, said concentration being gradually decreased from the position $t_1$ to the interface position $t_T$ from the distribution concentration $C_2$. At the interface position $t_T$, the distribution concentration C is made $C_3$.

Figure 3:
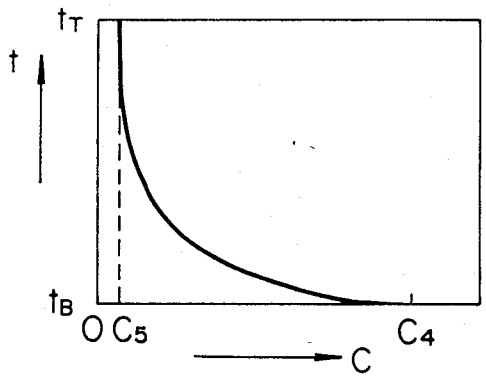

In the embodiment shown in FIG. 3, the distribution concentration C of the group V atoms contained is decreased gradually and continuously from the position $t_B$ to the position $t_T$ from the concentration $C_4$ until it becomes the concentration $C_5$ at the position $t_T$.

Figure 4:
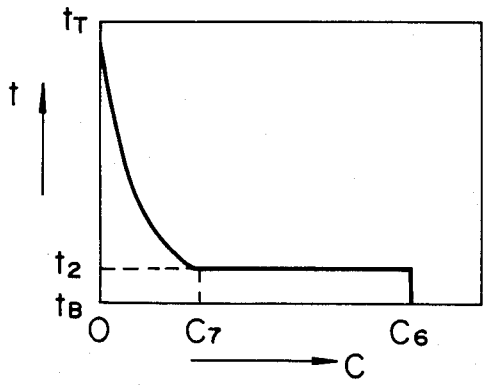

In case of FIG. 4, the distribution concentration C of the group V atoms is made constant as $C_6$ from the position $t_B$ to the position $t_2$ and gradually continuously decreased from the position $t_2$ to the position $t_T$, and the distribution concentration C is made substantially zero at the position $t_T$.

Figure 5:
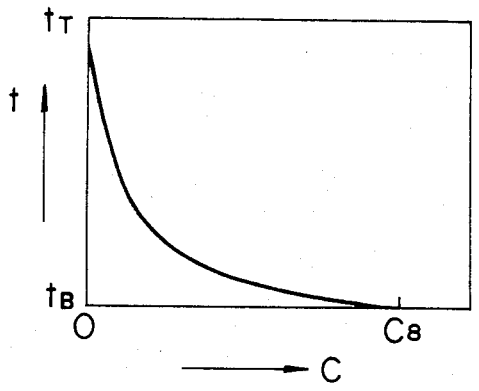

In case of FIG. 5, the distribution concentration of the group V atoms is decreased gradually and continuously from the position $t_B$ to the position $t_T$ from the concentration $C_8$, until it is made substantially zero at the position $t_T$.

Figure 6:
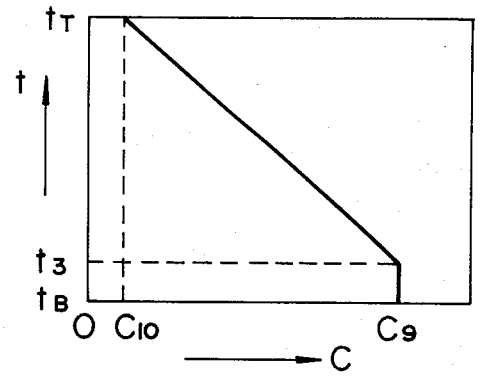

In the embodiment shown in FIG. 6, the distribution concentration C of the group V atoms is constantly $C_9$ between the position $t_B$ and the position $t_3$, and it is made $C_{10}$ at the position $t_T$. Between the position $t_3$ and the position $t_T$, the distribution concentration C is decreased as a first order function from the position $t_3$ to the position $t_T$.

Figure 7:
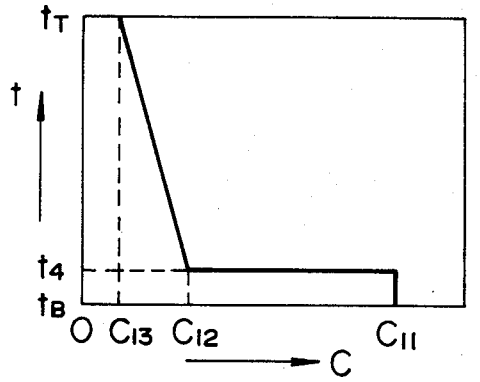

In the embodiment shown in FIG. 7, there is formed a depth profile such that the distribution concentration takes a constant value of $C_{11}$ from the position $t_B$ to the position $t_4$, and is decreased as a first order function from the concentration $C_{12}$ to the concentration $C_{13}$ from the position $t_4$ to the position $t_T$.

Figure 8:
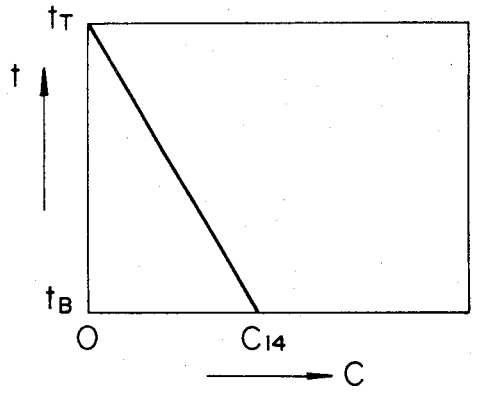

In the embodiment shown in FIG. 8, the distribution concentration C of the group V atoms is decreased as a first order function from the concentration $C_{14}$ to zero from the position $t_B$ to the position $t_T$.

Figure 9:
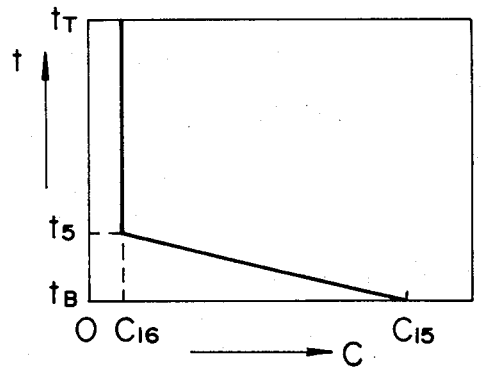

In FIG. 9, there is shown an embodiment, where the distribution concentration C of the group V atoms is decreased as a first order function from the concentration $C_{15}$ to $C_{16}$ from the position $t_B$ to $t_5$ and made constantly at the concentration $C_{16}$ between the position $t_5$ and $t_T$.

Figure 10:
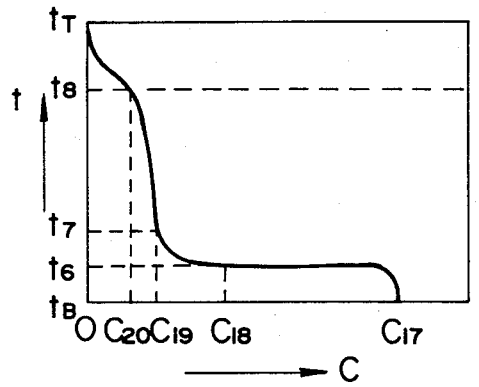

In the embodiment shown in FIG. 10, the distribution concentration C of the group V atoms is at the concentration $C_{17}$ at the position $t_B$, which concentration $C_{17}$ is initially decreased gradually and abruptly near the position $t_6$, until it is made the concentration $C_{18}$ at the position $t_6$.

Between the position $t_6$ and the position $t_7$, the distribution concentration is initially decreased abruptly and thereafter decreased gradually, until it is made the concentration $C_{19}$ at the position $t_7$. Between the position $t_7$ and the position $t_8$, the concentration is decreased very gradually to the concentration $C_{20}$ at the position $t_8$. Between the position $t_8$ and the position $t_T$, the concentration is decreased along the curve having a shape as shown in the Figure from the concentration $C_{20}$ to substantially zero.

As described above about some typical examples of the distribution states of the group V atoms contained in the layer region (V) in the direction of the layer thickness, in the present invention, the layer region (V) is provided in the amorphous layer in a distribution so as to have a portion made high in distribution concentration C of the group V atoms on the support side and a portion made lower in distribution concentration C of the group V atoms than that of the support side on the interface $t_T$ side.

In the present invention, the layer region (V) which constitutes the amorphous layer may preferably have a localized region (A) containing the group V atoms at a relatively higher concentration on the support side.

The localized region (A), as explained in terms of the symbols shown in FIG. 2 through FIG. 10, may be desirably provided within 5μ from the interface position $t_B$.

The above localized region (A) may be made to be identical with the whole layer region ($L_T$) up to the depth of 5μ thickness from the interface position $t_B$, or alternatively may be a part of the layer region ($L_T$).

It may suitably be determined depending on the characteristics required for the amorphous layer to be formed, whether the localized region (A) is made a part or whole of the layer region ($L_T$).

The localized region (A) may be preferably formed such that the maximum, Cmax of the concentrations of the group V atoms in a distribution in the layer thickness direction (distribution concentration values) may preferably be 100 atomic ppm or more, more preferably 150 atomic ppm or more, most preferably 200 atomic ppm or more, based on the silicon atoms.

That is, according to the present invention, the layer region (V) is formed so that the maximum value Cmax of the distribution concentration may exist within a layer thickness of 5μ from the support side (the layer region within 5μ thickness from $t_B$).

By providing the localized region (A) containing the group V atoms at higher concentration on the support side in the layer region (V), the injection of charges from the support side into the amorphous layer can be effectively inhibited.

In the present invention, the content of the group V atoms in the aforesaid layer region (V) containing the group V atoms, which may suitably be determined as desired so as to achieve effectively the objects of the present invention, may preferably be 30 to $5\times10^4$ atomic ppm, more preferably 50 to $1\times10^4$ atomic ppm, most preferably 100 to $5\times10^3$ atomic ppm.

In the present invention, as for the content of oxygen atoms to be contained in the amorphous layer, it may also be determined suitably depending on the characteristics required for the photoconductive member formed, but preferably 0.001 to 30 atomic %, more preferably 0.02 to 20 atomic %, most preferably 0.003 to 10 atomic %. In the photoconductive member of the present invention, the layer thickness $T_B$ of the layer region (V) containing the group V atoms (the layer thickness of the layer region 103 in FIG. 1) and the layer thickness T of the layer region containing no group V atom provided on the layer region (V), namely the layer region (B) of the portion excluding the layer region (V) (the layer region 104 in FIG. 1) may suitably be determined according to the intended purposes during design of the layers.

In the present invention, the layer thickness $T_b$ of the layer region (V) containing the group V atoms may preferably be 30 Å to 5μ, more preferably 40 Å to 4μ, most preferably 50 Å to 3μ, while the layer thickness T of the layer region (B) preferably 0.2 to 95μ, more preferably 0.5 to 76μ, most preferably 1 to 47μ.

Also, the sum of the above layer thickness T and $T_B$, namely ($T+T_B$) may preferably be 1 to 100μ, more preferably 1 to 80μ, most preferably 2 to 50μ.

In the present invention, formation of an amorphous layer comprising a-Si(H,X) may be conducted according to the vacuum deposition method utilizing discharging phenomenon, such as glow discharge method, sputtering method or ion-plating method. For example, for formation of the first amorphous layer (I) comprising a-Si(H,X) according to the glow discharge method, the basic procedure comprises introducing a starting gas for introduction of hydrogen atoms (H) or/and halogen atoms (X) together with a starting gas for supplying silicon atoms (Si) into the deposition chamber which can be internally brought to a reduced pressure, and exciting glow discharge in said deposition chamber, thereby forming a layer comprising a-Si(H,X) on the surface of a support set at a predetermined position. For formation of the layer according to the sputtering method, when effecting sputtering with a target constituted of Si in an atmosphere of, for example, an inert gas such as Ar, He, etc. or a gas mixture based on these gases, a gas for introduction of hydrogen atoms (H) or/and halogen atoms (X) may be introduced into the deposition chamber for sputtering.

In the present invention, illustrative of halogen atoms optionally incorporated in the amorphous layer are fluorine, chlorine, bromine and iodine, of which fluorine and chlorine are particularly preferred.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

Effective starting gases for introduction of halogen atoms to be used in the present invention may include a large number of gaseous or gasifiable halogen compounds, as exemplified by halogen gases, halides, interhalogen compounds, or silane derivatives substituted with halogen.

Further, there may also be included gaseous or gasifiable silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, inerhalogen compounds such as BrF, ClF, $ClF_3$, $BrF_5$, $BrF_3$, $IF_3$, $IF_7$,ICl, IBr, etc.

As the silicon compounds containing halogen atoms, namely so called silane derivatives substituted with halogens, there may be preferably employed silicon halides such as $SiF_4$, $Si_2F_6$, $SiCl_4$, $SiBr_4$ and the like.

When the characteristic photoconductive member of the present invention is to be formed according to the glow discharge method by employment of such a silicon compound containing halogen atoms, it is possible to form an amorphous layer comprising a-Si:X on a certain support without use of a hydrogenated silicon gas as the starting material capable of supplying Si.

For formation of an amorphous layer containing halogen atoms according to the glow discharge method, the basic procedure comprises introducing a silicon halide gas as the starting gas for supplying silicon atoms and a gas such as Ar, $H_2$, He, etc. at a predetermined mixing ratio and gas flow rates into a deposition chamber for formation of the amorphous layer and exciting glow discharging therein to form a plasma atmosphere of these gases, whereby the amorphous layer can be formed on a certain support. For the purpose of introduction of hydrogen atoms, these gases may further be admixed at a desired level with a gas of a silicon compound containing hydrogen atoms.

Also, the respective gases may be used not only as single species but as a mixture of plural species.

For formation of an amorphous layer comprising a-Si(H,X) according to the reactive sputtering method or the ion plating method, for example, in case of the sputtering method, sputtering may be effected by use of a target of Si in a certain gas plasma atmosphere; or in case of the ion plating method, a polycrystalline silicon or a single crystalline silicon is placed as a vapor source in a vapor deposition boat and the silicon vapor source is vaporized by heating according to the resistance heating method or the electron beam method (EB method), and the resultant flying vaporized product is permitted to pass through the gas plasma atmosphere.

During this procedure, in either of the sputtering method or the ion plating method, introduction of halogen atoms into the layer formed may be effected by introducing a gas of a halogen compound or a silicon compound containing halogen atoms as described above into the deposition chamber and forming a plasma atmosphere of said gas.

Also, for introduction of hydrogen atoms, a starting gas for introduction of hydrogen atoms, such as $H_2$, or a gas of silanes such as those mentioned above may be introduced into the deposition chamber and a plasma atmosphere of said gas may be formed therein.

In the present invention, as the starting gas for introduction of halogen atoms, the halogen compounds or silicon compounds containing halogens as mentioned above can effectively be used. In addition, it is also possible to use a gaseous or gasifiable halide containing hydrogen atom as one of the constituents such as hydrogen halide, including HF, HCl, HBr, HI and the like or halogen-substituted hydrogenated silicon, including $SiH_2F_2$, $SiH_2I_2$, $SiH_2Cl_2$, $SiHCl_3$, $SiH_2Br_2$, $SiHBr_3$ and the like as an effective starting material for formation of an amorphous layer.

These halides containing hydrogen atom, which can introduce hydrogen atoms very effective for controlling electrical or photoelectric characteristics into the layer during formation of the amorphous layer simultaneously with introduction of halogen atoms, can preferably be used as the starting material for introduction of halogen atoms.

For incorporation of hydrogen atoms structurally into the amorphous layer, other than the above method, $H_2$ or a gas of hydrogenated silicon, including $SiH_4$, $Si_2H_6$, $Si_3H_8$ and $Si_4H_{10}$ and so on may be permitted to be co-present with a silicon compound for supplying Si in a deposition chamber, wherein discharging is excited.

For example, in case of the reactive sputtering method, a Si target is used and a gas for introduction of halogen atoms and $H_2$ gas are introduced together with, if necessary, an inert gas such as He, Ar, etc. into a deposition chamber, wherein a plasma atmosphere is formed to effect sputtering with said Si target, thereby forming the amorphous layer comprising a-Si(H,X) on the substrate.

Further, there may also be introduced a gas such as of $B_2H_6$ or others in order to effect also doping of impurities.

The amount of hydrogen atoms (H) or halogen atoms (X) incorporated in the amorphous layer in the photoconductive member formed in the present invention, or total amount of both of these atoms, may be preferably 1 to 40 atomic %, more preferably 5 to 30 atomic %.

For controlling the amounts of hydrogen atoms (H) or/and halogen atoms (X) in the amorphous layer, the support temperature or/and the amounts of the starting materials for incorporation of hydrogen atoms (H) or halogen atoms (X) to be introduced into the deposition device system or the discharging power may be controlled.

The layer region (V) containing the group V atoms may be provided in the amorphous layer by incorporating a starting material for introduction of the group V atoms in combination with a starting material for formation of the amorphous layer, while controlling its amount, in the layer to be formed during formation of the amorphous layer according to the glow discharge method or the reactive sputtering method.

When the glow discharge method is employed in forming the layer resion (V) constituting the amorphous layer, as the starting material to be used as a starting gas for formation of said layer region (V), a starting material for introduction of the group V atoms may be added to the starting material for formation of the amorphous layer which is chosen as desired from those as described above. As such a starting material for introducing the group V atoms, there may be employed most of gaseous or gasified gasifiable substances containing at least the group V atoms as constituent atoms.

When the layer region (V) is to be formed according to the glow discharge method, the starting materials to be effectively used in the present invention for introduction of the group V atoms may include phosphorus hydrides such as $PH_3$, $P_2H_4$ and the like, phosphorus halides such as $PH_4I$, $PF_3$, $PF_5$, $PCl_3$, $PCl_5$, $PBr_3$, $PBr_5$, $PI_3$ and the like for introduction of phosphorus atom. In addition, there may also be included $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$ and the like.

The content of the group V atoms to be introduced into the layer region (V) can freely be controlled by controlling the flow rate, flow rate ratio of the starting materials for introduction of the group V atoms to be flown into the deposition chamber, the discharging power, the support temperature, the pressure in the deposition chamber and others.

In the present invention, as diluting gases to be used in formation of the amorphous layer according to the glow discharge method or as gases for sputtering during formation of the layer according to the sputtering method, there may be employed so called rare gases such as He, Ne, Ar and the like.

In the photoconductive member of the present invention, the electric conduction characteristic of the layer region (B) containing no group V atom (corresponding to the layer region 104 in FIG. 1) provided on the layer region (V) can freely be controlled as desired by incorporating a substance for controlling the electric conduction characteristic to said layer region (B).

As such a substance, there may be mentioned the so called impurities in the field of semiconductors. As p-type impurities for imparting p-type conduction characteristic to a-Si(H,X) constituting the amorphous layer to be formed in the present invention, there may be mentioned the atoms belonging to the aforesaid group III of the periodic table (the group III atoms), as exemplified by B (boron), Al (aluminum), Ga (gallium), In (indium), Tl (thallium), etc. In particular, B and Ga are preferred.

In the present invention, the content of the substance for controlling the conduction characteristic in the layer region (B) may be determined suitably depending on organic relationships with the conduction characteristic required for said layer region (B), the characteristics of other layer provided in direct contact with said layer region (B), the characteristic at the contact interface with said other layers, etc.

In the present invention, the content of the substance for controlling the conduction characteristic in the layer region (B) is preferably 0.001 to 1000 atomic ppm, more preferably 0.05 to 500 atomic ppm, most preferably 0.1 to 200 atomic ppm.

For introducing structually a substance for controlling the conduction characteristic, for example, the group III atoms into the layer region (B), the starting material for introduction of the group III atoms can be introduced under gaseous state into a deposition chamber together with other starting materials for formation of the amorphous layer. As the material which can be used as such starting materials for introduction of the group III atoms, there may be desirably employed those which are gaseous under the conditions of normal temperature and normal pressure, or at least readily gasifiable under layer forming conditions. Illustrative of such starting materials for introduction of the group III atoms are boron hydrides such as $B_2H_6$, $B_4H_{10}$, $B_5H_9$, $B_5H_{11}$, $B_6H_{10}$, $B_6H_{12}$, $B_6H_{14}$ and the like, boron halides such as $BF_3$, $BCl_3$, $BBr_3$ and the like. In addition, there may also be included $AlCl_3$, $GaCl_3$, $Ga(CH_3)_3$, $InCl_3$, $TlCl_3$ and the like.

The support to be used in the present invention may be either electroconductive or insulating. As the electroconductive support, there may be mentioned metals such as NiCr, stainless steel, Al, Cr, Mo, Au, Nb, Ta, V, Ti, Pt, Pd, etc. or alloys thereof.

As insulating supports, there may usually be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These insulating supports may preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is optionally determined so that a photoconductive member as desired may be formed. When the photoconductive member is required to have a flexibility, the support is made as thin as possible, so far as the function of a support can be exhibited. However, in such a case, the thickness is generally 10$\mu$ or more from the points of fabrication and handling of the support as well as its mechanical strength.

Figure 11:
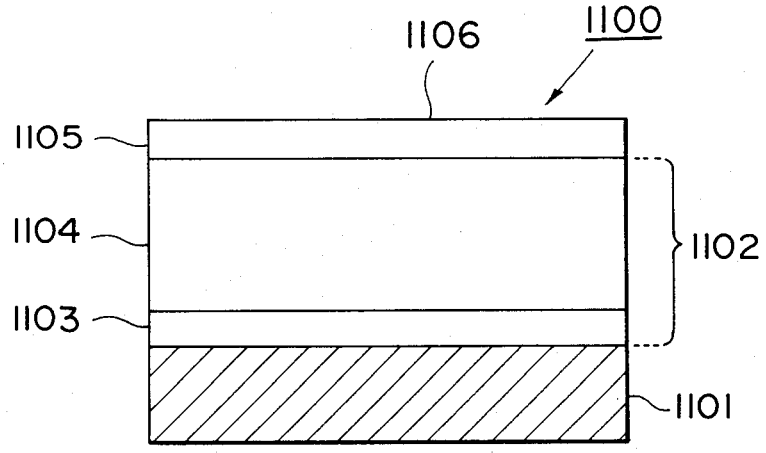

FIG. 11 is a schematic illustration of the layer constitution of another embodiment of the photoconductive member of the present invention.

The photoconductive member 1100 as shown in FIG. 11 has a first amorphous layer (I) 1102 comprising a-Si, preferably a-Si(H,X), and having photoconductivity and a second amorphous layer (II) 1105 on a support 1101 for photoconductive member, the second amorphous layer (II) 1105 having a free surface 1106.

The photoconductive member 1100 as shown in FIG. 11 has the same layer constitution as the photoconductive member 100 as shown in FIG. 1 except for having a second amorphous layer (II) 1105 on a first amorphous layer (I) 1102.

That is, the first amorphous layer (I) 1102 has a layer structure constituted so as to have a layer region (V) 1103 containing oxygen atoms as constituent atoms throughout the whole layer region and the group V atoms as constituent atoms in a distribution state in which the group V atoms are distributed continuously in the layer thickness direction and more enriched toward the aforesaid support 1101, and an upper layer region 1104, and the constituent materials, the conditions and the procedures for preparation thereof are the same as described for the amorphous layer 102 in FIG. 1.

The second amorphous layer (II) 1105 in case of the photoconductive member 1100 as shown in FIG. 11 comprises an amorphous material having silicon atoms and carbon atoms, if necessary, at least either one of hydrogen atoms or halogen atoms as constituent atoms [hereinafter written as "a-SiC(H,X)"] and has a free surface 1107.

The second amorphous layer (II) 1105 is provided primarily for the purpose of accomplishing the objects of the present invention with respect to humidity resistance, continuous and repeated use characteristics, dielectric strength, environmental characteristics during use and durability.

In the photoconductive member 1100 as shown in FIG. 11, since each of the amorphous materials forming the first amorphous layer (I) 1102 and the second amorphous layer (II) 1105 have the common constituent of silicon atom, chemical and electric stabilities are sufficiently ensured at the laminated interface.

As a-SiC(H,X) constituting the second amorphous layer (II), there may be mentioned an amorphous material constituted of silicon atoms and carbon atoms (a-$Si_aC_{1-a}$, where $0<a<1$), an amorphous material constituted of silicon atoms, carbon atoms and hydrogen atoms [a-$(Si_bC_{1-b})_cH_{1-c}$, where $0<a$, $b<1$] and an amorphous material constituted of silicon atoms, carbon atoms, halogen atoms and, if desired, hydrogen atoms [a-$(Si_dC_{1-d})_e(X,H)_{1-e}$, where $0<d$, $e<1$] as effective materials.

Formation of the second amorphous layer (II) comprising a-SiC(H,X) may be performed according to the glow discharge method, the sputtering method, the ion implantation method, the ion plating method, the electron beam method, etc. These preparation methods may be suitably selected depending on various factors such as the preparation conditions, the degree of the load for capital investment on installations, the production scale, the desirable characteristics required for the photoconductive member to be prepared, etc. For the advantages of relatively easy control of the preparation conditions for preparing photoconductive members having desired characteristics and easy introduction of silicon atoms and carbon atoms, optionally together with hydrogen atoms or halogen atoms, into the second amorphous layer (II) to be prepared, there may preferably be employed the glow discharge method or the sputtering method.

Further, in the present invention, the second amorphous layer (II) may be formed by using the glow discharge method and the sputtering method in combination in the same device system.

For formation of the second amorphous layer (II) according to the glow discharge method, starting gases for formation of a-SiC(H,X), optionally mixed at a predetermined mixing ratio with diluting gas, may be introduced into a deposition chamber for vacuum deposition in which a support is placed, and the gas introduced is made into a gas plasma by excitation of glow discharging, thereby depositing a-SiC(H,X) on the first amorphous layer (I) which has already been formed on the aforesaid support.

As the starting gases for formation of a-SiC(H,X) to be used in the present invention, it is possible to use most of gaseous substances or gasified gasifiable substances containing at least one of Si, C, H and X as constituent atoms.

In case when a starting gas having Si as constituent atoms as one of Si, C, H and X is employed, there may be employed, for example, a mixture of a starting gas containing Si as constituent atom with a starting gas containing C as constituent atom and a starting gas containing H or X as constituent atom at a desired mixing ratio, or alternatively a mixture of a starting gas containing Si as constituent atoms with a starting gas containing C and H or X as constituent atoms at a desired mixing ratio, or a mixture of a starting gas containing Si as constituent atoms with a gas containing three atoms of Si, C and H or of Si, C and X as constituent atoms.

Alternatively, it is also possible to use a mixture of a starting gas containing Si and H or X as constituent atoms with a starting gas containing C as constituent atom.

In the present invention, the starting gases effectively used for formation of the second amorphous layer (II) may include hydrogenated silicon gases containing Si and H as constituent atoms such as silanes (e.g. $SiH_4$, $Si_2H_6$, $Si_3H_8$, $Si_4H_{10}$, etc.), compounds containing C and H as constituent atoms such as saturated hydrocarbons having 1 to 5 carbon atoms, ethylenic hydrocarbons having 2 to 5 carbon atoms and acetylenic hydrocarbons having 2 to 4 carbon atoms.

More specifically, there may be included, as saturated hydrocarbons, methane ($CH_4$), ethane ($C_2H_6$), propane) ($C_3H_8$), n-butane (n-$C_4H_{10}$), pentane ($C_5H_{12}$); as ethylenic hydrocarbons, ethylene ($C_2H_4$), propylene ($C_3H_6$), butene-1 ($C_4H_8$), butene-2 ($C_4H_8$), isobutylene ($C_4H_8$), pentene ($C_5H_{10}$); as acetylenic hydrocarbons, acetylene ($C_2H_2$), methyl acetylene ($C_3H_4$), butyne ($C_4H_6$); and the like.

As the starting gas containing Si, C and H as constituent atoms, there may be mentioned alkyl silanes such as $Si(CH_3)_4$, $Si(C_2H_5)_4$ and the like. In addition to these starting gases, it is also possible as a matter of course to use $H_2$ as effective starting gas for introduction of H.

In the present invention, preferable halogen atoms (X) to be contained in the second amorphous layer (II) are F, Cl, Br and I. Particularly, F and Cl are preferred.

Incorporation of hydrogen atoms into the second amorphous layer (II) is convenient from aspect of production cost, because a part of starting gas species can be made common in forming continuous layers together with the first amorphous layer (I).

In the present invention, as the starting gas which can be used effectively for introduction of halogen atoms (X) in formation of the second amorphous layer (II), there may be mentioned gaseous substances under conditions of normal temperature and normal pressure or readily gasifiable substances.

Such starting gases for introduction of halogen atoms (X) may include single halogen substances, hydrogen halides, interhalogen compounds, silicon halides, halo-substituted hydrogenated silicons and the like.

More specifically, there may be mentioned, as single halogen substances, halogen gases such as of fluorine, chlorine, bromine and iodine; as hydrogen halides, FH, HI, HCl, HBr; as interhalogen compounds, BrF, ClF, $ClF_3$, $ClF_5$, $BrF_5$, $BrF_3$, $IF_7$, $IF_5$, ICl, IBr; as silicon halides, $SiF_4$, $Si_2F_6$, $SiCl_4$, $SiCl_3Br$, $SiCl_2Br_2$, $SiClBr_3$, $SiCl_3I$, $SiBr_4$, as halo-substituted hydrogenated silicon $SiH_2F_2$, $SiH_2Cl_2$, $SiHCl_3$, $SiH_3Cl$, $SiH_3Br$, $SiH_2Br_2$, $SiHBr_3$; and so on.

In addition to these materials, there may also be employed halo-substituted paraffinic hydrocarbons such as $CCl_4$, $CHF_3$, $CH_2F_2$, $CH_3F$, $CH_3Cl$, $CH_3Br$, $CH_3I$, $C_2H_5Cl$ and the like, fluorinated sulfur compounds such as $SF_4$, $SF_6$ and the like, halo-containing alkyl silanes such as $SiCl(CH_3)_3$, $SiCl_2(CH_3)_2$, $SiCl_3CH_3$ and the like, as effective materials.

For formation of the second amorphous layer (II) according to the sputtering method, a single crystalline or polycrystalline Si wafer or C wafer or a wafer containing Si and C mixed therein is used as target and subjected to sputtering in an atmosphere of various gases.

For example, when Si wafer is used as target, a starting gas for introducing at least C, which may be diluted with a diluting gas, if desired, is introduced into a deposition chamber for sputter to form a gas plasma therein and effect sputtering with said Si wafer.

Alternatively, Si and C as separate targets or one sheet target of a mixture of Si and C can be used and sputtering is effected in a gas atmosphere containing, if necessary, at least hydrogen atoms or halogen atoms.

As the starting gas for introduction of C or for introduction of H or X, there may be employed those as mentioned in the glow discharge as described above as effective gases also in case of sputtering.

In the present invention, as the diluting gas to be used in forming the second amorphous layer (II) by the glow discharge method or the sputtering method, there may preferably employed so called rare gases such as He, Ne, Ar and the like.

The second amorphous layer (II) in the present invention should be carefully formed so that the required characteristics may be given exactly as desired.

That is, a substance containing as constituent atoms Si, C and, if necessary, H or/and X can take various forms from crystalline to amorphous, electrical properties from conductive through semi-conductive to insulating and photoconductive properties from photoconductive to non-photoconductive depending on the preparation conditions. Therefore, in the present invention, the preparation conditions are strictly selected as desired so that there may be formed a-SiC(H,X) having desired characteristics depending on the purpose.

For example, when the second amorphous layer (II) is to be provided primarily for the purpose of improvement of dielectric strength, a-SiC(H,X) is prepared as an amorphous material having marked electric insulating behaviours under the usage conditions.

Alternatively, when the primary purpose for provision of the second amorphous layer (II) is improvement of continuous repeated use characteristics or environmental use characteristics, the degree of the above electric insulating property may be alleviated to some extent and a-SiC(H,X) may be prepared as an amorphous material having sensitivity to some extent to the light irradiated.

In forming the second amorphous layer (II) comprising a-SiC(H,X) on the surface of the first amorphous layer (I), the support temperature during layer formation is an important factor having influences on the structure and the characteristics of the layer to be formed, and it is desired in the present invention to control severely the support temperature during layer formation so that a-SiC(H,X) having intended characteristics may be prepared as desired.

As the support temperature in forming the second amorphous layer (II) for accomplishing effectively the objects in the present invention, there may be selected suitably the optimum temperature range in conformity with the method for forming the second amorphous layer (II) in carrying out formation of the second amorphous layer (II).

When the second amorphous layer (II) is to be formed of a-$Si_aC_{1-a}$, the support temperature may preferably be 20° to 300° C., more preferably 20° to 250° C.

When the second amorphous layer (II) is to be formed of a-$(Si_bC_{1-b})_cH_{1-c}$ or a-$(Si_dC_{1-d})_e(X,H)_{1-e}$, the support temperature may preferably be 50° to 350° C., more preferably 100° to 250° C.

For formation of the second amorphous layer (II), the glow discharge method or the sputtering method may be advantageously adopted, because severe control of the composition ratio of atoms constituting the layer or control of layer thickness can be conducted with relative ease as compared with other methods. In case when the second amorphous layer (II) is to be formed according to these layer forming methods, the discharging power, the gas pressure during layer formation is one of important factors influencing the characteristics of a-SiC(H,X) to be prepared, similarly as the aforesaid support temperature.

The discharging power condition for preparing effectively a-$Si_aC_{1-a}$ having characteristics for accomplishing the objects of the present invention with good productivity may preferably be 50 W to 250 W, most preferably 80 W to 150 W.

The discharging power conditions, in case of a-$(Si_bC_{1-b})_cH_{1-c}$ or a-$(Si_dC_{1-d})_e(H,X)_{1-e}$, may preferably be 10 to 300 W, more preferably 20 to 200 W.

The gas pressure in a deposition chamber may preferably be 0.01 to 5 Torr, more preferably 0.01 to 1 Torr, most preferably 0.1 to 0.5 Torr.

In the present invention, the above numerical ranges may be mentioned as preferable numerical ranges for the support temperature, discharging power, etc. However, these factors for layer formation should not determined separately independently of each other, but it is desirable that the optimum values of respective layer forming factors should be determined based on mutual organic relationships so that a second amorphous layer comprising a-SiC(H,X) having desired characteristics may be formed.

The contents of carbon atoms and hydrogen atoms in the second amorphous layer (II) in the photoconductive member of the present invention are important factors for obtaining the desired characteristics to accomplish the objects of the present invention, similarly as the conditions for preparation of the second amorphous layer (II).

The content of carbon atoms contained in the second amorphous layer (II) in the present invention, when it is constituted of a-$Si_aC_{1-a}$, may be generally $1\times10^{-3}$ to 90 atomic %, preferably 1 to 80 atomic %, most preferably 10 to 75 atomic %. That is, in terms of the aforesaid representation a in the formula a-$Si_aC_{1-a}$, a may be generally 0.1 to 0.99999, preferably 0.2 to 0.99, most preferably 0.25 to 0.9.

When the second amorphous layer (II) is constituted of a-$(Si_bC_{1-b})_cH_{1-c}$, the content of carbon atoms contained in said layer (II) may be generally $1\times10^{-3}$ to 90 atomic %, preferably 1 to 90 atomic %, most preferably 10 to 80 atomic %. The content of hydrogen atoms may be generally 1 to 40 atomic %, preferably 2 to 35 atomic %, most preferably 5 to 30 atomic %. A photoconductive member formed to have a hydrogen atom content with these ranges is sufficiently applicable as an excellent one in practical applications.

That is, in terms of the representation by a-$(Si_bC_{1-b})_cH_{1-c}$, b may be generally 0.1 to 0.99999, preferably 0.1 to 0.99, most preferably 0.15 to 0.9, and c generally 0.6 to 0.99, preferably 0.65 to 0.98, most preferably 0.7 to 0.95.

When the second amorphous layer (II) is constituted of a-$(Si_dC_{1-d})_e(X,H)_{1-e}$, the content of carbon atoms contained in said layer (II) may be generally $1\times10^{-3}$ to 90 atomic %, preferably 1 to 90 atomic %, most preferably 10 to 80 atomic %. The content of halogen atoms may be generally 1 to 20 atomic %, preferably 1 to 18 atomic %, most preferably 2 to 15 atomic %. A photoconductive member formed to have a halogen atom content with these ranges is sufficiently applicable as an excellent one in practical applications. The content of hydrogen atoms to be optionally contained may be generally 19 atomic % or less, preferably 13 atomic % or less. That is, in terms of the representation by a-$(Si_dC_{1-d})_e(X,H)_{1-e}$, d may be generally 0.1 to 0.99999, preferably 0.1 to 0.99, most preferably 0.15 to 0.9, and e generally 0.8 to 0.99, preferably 0.82 to 0.99, most preferably 0.85 to 0.98.

The range of the numerical value of layer thickness of the second amorphous layer (II) is one of important factors for accomplishing effectively the objects of the present invention.

The range of the numerical value of layer thickness of the second amorphous layer (II) should desirably be determined depending on the intended purpose so as to effectively accomplish the objects of the present invention.

The layer thickness of the second amorphous layer (II) is required to be determined as desired suitably with due considerations about the relationships with the contents of carbon atoms, hydrogen atoms or halogen atoms, the layer thickness of the first amorphous layer (I), as well as other organic relationships with the characteristics required for respective layer regions. In addition, it is also desirable to have considerations from economical point of view such as productivity or capability of bulk production.

The second amorphous layer (II) in the present invention is desired to have a layer thickness generally of 0.003 to 30μ, preferably 0.004 to 20μ, most preferably 0.005 to 10μ.

Next, one example of the process for producing the photoconductive member of the present invention is to be briefly described.

Figure 12:
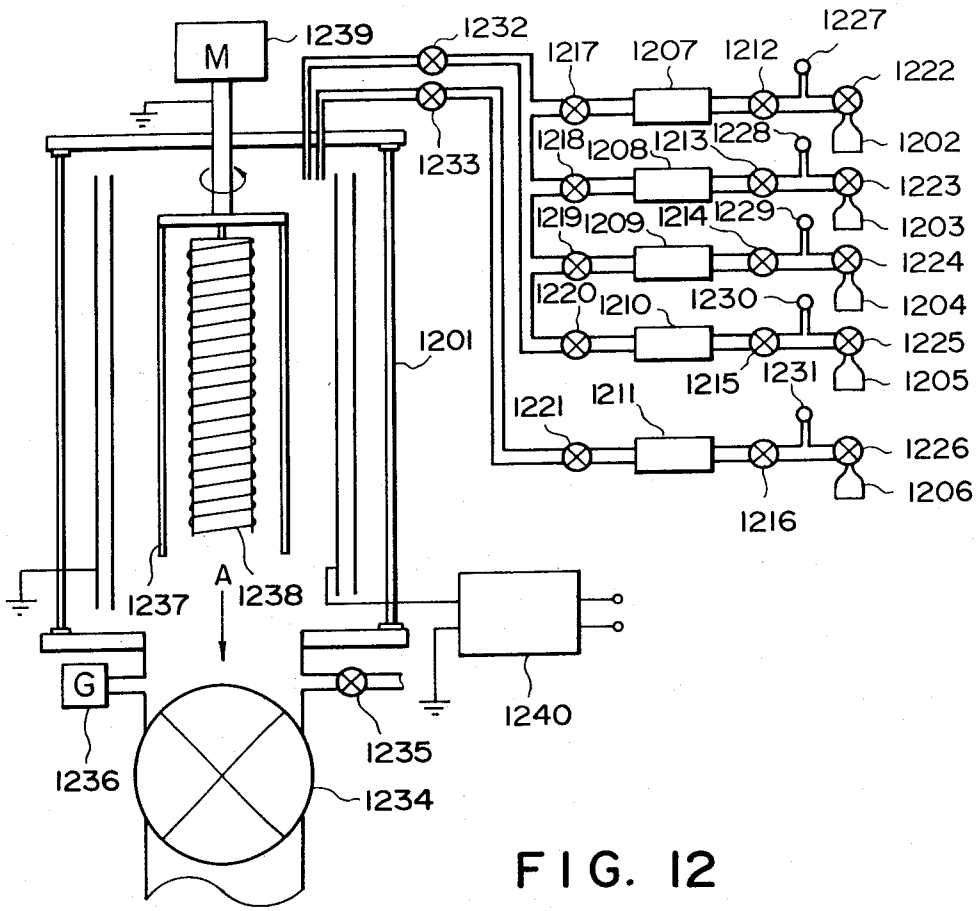
FIG. 12 and FIG. 13 show flow charts for illustration of the devices used for preparation of the photoconductive members of the present invention, respectively.

FIG. 12 shows an example of the device for producing a photoconductive member.

In the gas bombs 1202, 1203, 1204, 1205 and 1206, there are hermetically contained starting gases for formation of respective layers of the present invention. For example, 1202 is a bomb containing $SiH_4$ gas (purity: 99.999%) diluted with He (hereinafter abbreviated as "$SiH_4$/He"), 1203 is a bomb containing $B_2H_6$ gas (purity: 99.999%) diluted with He (hereinafter abbreviated as "$B_2H_6$/He"), 1204 is a bomb containing $PH_3$ gas (purity: 99.99%) diluted with He (hereinafter abbreviated as "$PH_3$/He"), 1205 is a bomb containing $SiF_4$ gas (purity: 99.999%) diluted with He (hereinafter abbreviated as "$SiF_4$/He") and 1206 is a bomb containing NO gas (purity: 99.99%).

For allowing these gases to flow into the reaction chamber 1201, on confirmation of the valves 1222–1226 of the gas bombs 1202–1206 and the leak valve 1235 to be closed, and the inflow valves 1212–1216, the outflow valves 1217–1221 and the auxiliary valves 1232, 1233 to be opened, the main valve 1234 is first opened to evacuate the reaction chamber 1201 and the gas pipelines. As the next step, when the reading on the vacuum indicator 1236 becomes about $5\times10^{-6}$ Torr, the auxiliary valve 1232, 1233 and the outflow valves 1217–1221 are closed.

To mention about one example of forming an amorphous layer comprising a-Si(H,X) on a cylindrical substrate 1237, $SiH_4$/He gas from the gas bomb 1202, $PH_3$/He gas from the gas bomb 1204 and NO gas from the gas bomb 1206 are permitted to flow into the mass-flow controllers 1207, 1209 and 1211, respectively, by opening the valves 1222, 1224 and 1226 to control the pressures at the outlet pressure gauges 1227, 1229 and 1230 to 1 Kg/cm$^2$ and opening gradually the inflow valves 1212, 1214 and 1216. Subsequently, the outflow valves 1217, 1219, 1221 and the auxiliary valves 1232, 1233 are gradually opened to permit respective gases to flow into the reaction chamber 1201. The outflow valves 1217, 1219 and 1221 are controlled so that the relative flow rate ratio of $SiH_4$/He gas:$PH_3$/He gas:NO gas may have a desired value and opening of the main valve 1234 is also controlled while watching the reading on the vacuum indicator 1236 so that the pressure in the reaction chamber 1201 may reach a desired value. And, after confirming that the temperature of the support 1237 is set at 50°–400° C. by the heater 1238, the power source 1240 is set at a desired power to excite glow discharge in the reaction chamber 1201, while simultaneously carrying out the operation to change gradually the valve 1218 in accordance with the change ratio curve previously designed for changing the $PH_3$/He gas flow rate by the manual method or by means of an externally driven motor, thereby controlling the distribution content of phosphorus atoms (P) to be contained in the layer formed. In the manner as described above, there is first formed a layer region (P, O) containing phosphorus atoms and oxygen atoms on the support 1237.

During this operation, introduction of $PH_3$/He gas into the reaction chamber 1201 can be shut out by closing of the valves of the corresponding gas inlet tube, whereby the layer thickness of the layer region containing phosphorus can freely be controlled as desired.

After the layer region (P, O) containing phosphorus atoms and oxygen atoms has been formed to a desired thickness as described above, the outflow valve 1219 is closed and glow discharging is subsequently continued for a desired period of time to result in formation of a layer region (O) containing no phosphorus atom but containing oxygen atoms on the layer region (P, O) containing phosphorus atoms and oxygen atoms to a desired thickness, thus completing formation of the amorphous layer.

In case when halogen atoms (X) are to be incorporated in the amorphous layer, the gases employed for formation of the above respective layers are further added with, for example, $SiF_4$/He and delivered into the reaction chamber 1201.

Depending on the gas species chosen in formation of the amorphous layer, the layer forming speed can further be enhanced. For example, when layer formation is carried out by use of $Si_2H_6$ gas in place of $SiH_4$ gas, the layer formation speed can be enhanced to several times or more to improve productivity.

The outflow valves for gases other than those necessary for formation of respective layers are all closed as a matter of course, and during formation of respective layers, in order to avoid remaining of gases employed for formation of the previous layer in the pipelines from the outflow valves 1217–1221 to the reaction chamber 1201, there may be performed the operation to once evacuate the system to high vacuum by closing the outflow valves 1217–1221 and opening the auxiliary valves 1232 and 1233, with full opening of the main valve 1234.

Also, during the layer forming operation, the substrate 1237 is rotated at a constant speed by means of a motor 1239 in order to effect uniform layer formation.

Figure 13:
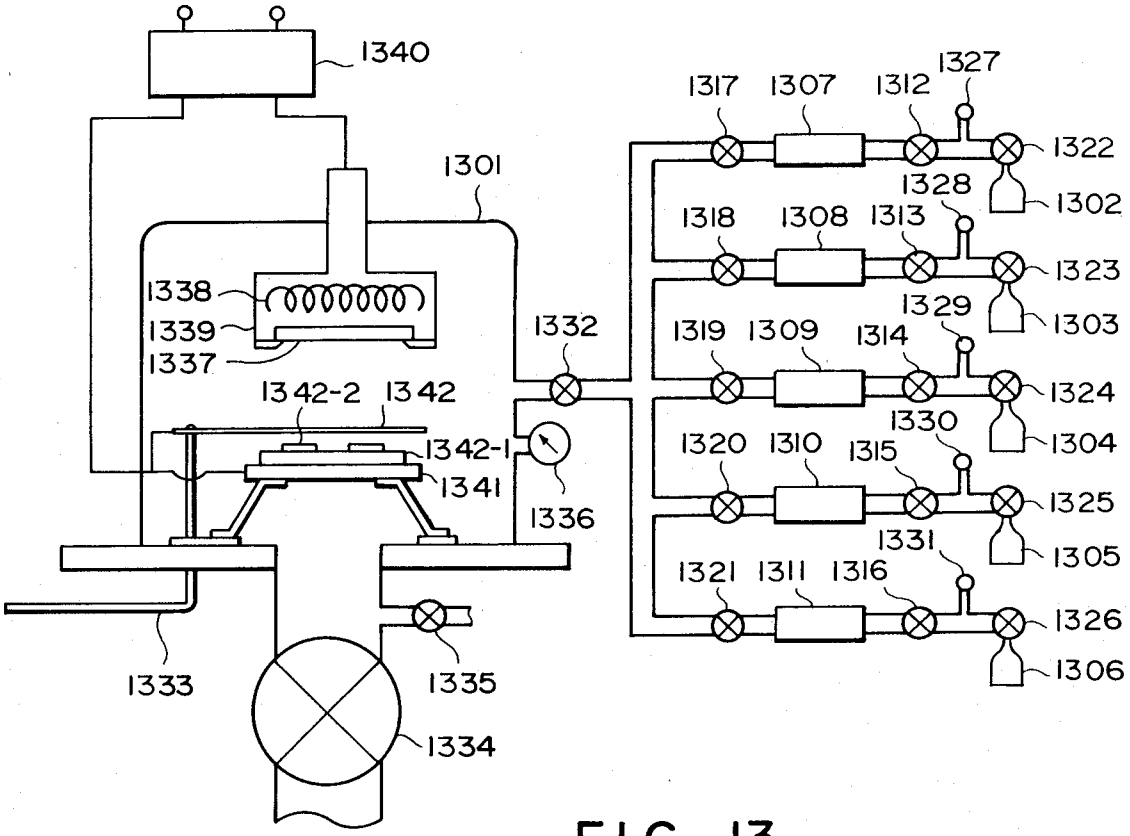

FIG. 13 shows another example of the device for preparation of photoconductive members.

In the gas bombs 1302 to 1306 in FIG. 13, there are hermetically contained starting gases for formation of respective layers of the present invention. For example, 1302 is a $SiH_4$/He gas bomb, 1303 is a $B_2H_6$/He gas bomb, 1304 is a $PH_3$/He gas bomb, 1305 is a $SiF_4$/He gas bomb and 1306 is a NO gas or $C_2H_4$ gas (purity: 99.99%) bomb.

For allowing these gases to flow into the reaction chamber 1301, on confirmation of the valves 1322–1326 of the gas bombs 1302–1306 and the leak valve 1335 to be closed, and the inflow valves 1312–1316, the outflow valves 1317–1321 and the auxiliary valve 1332 to be opened, the main valve 1334 is first opened to evacuate the reaction chamber 1301 and the gas pipelines. As the next step, when the reading on the vacuum indicator 1335 becomes about $5\times10^{-6}$ Torr, the auxiliary valve 1332 and the outflow valves 1317–1321 are closed.

Referring now to one example of forming a first amorphous layer (I) on a substrate 1337, $SiH_4$/He gas from the gas bomb 1302, $PH_3$/He gas from the gas bomb 1304 and NO gas from the gas bomb 1306 are permitted to flow into the mass-flow controllers 1307, 1309 and 1311, respectively, by opening the valves 1322, 1324 and 1326 to control the pressures at the outlet pressure gauges 1327, 1329 and 1331 to 1 $Kg/cm^2$ and opening gradually the inflow valves 1312, 1314 and 1316. Subsequently, the outflow valves 1317, 1319, 1321 and the auxiliary valve 1332 are gradually opened to permit respective gases to flow into the reaction chamber 1301. The outflow valves 1317, 1319 and 1321 are controlled so that the relative flow rate ratio of $SiH_4$/He gas:$PH_3$/He gas:NO gas may have a desired value and opening of the main valve 1334 is also controlled while watching the reading on the vacuum indicator 1336 so that the pressure in the reaction chamber 1301 may reach a desired value. And, after confirming that the temperature of the support 1337 is set at 50°–400° C. by the heater 1338, the power source 1340 is set at a desired power to excite glow discharge in the reaction chamber 1301, while simultaneously carrying out the operation to change gradually the valve 1318 in accordance with the change ratio curve previously designed for changing the $PH_3$/He gas flow rate by the manual method or by means of an externally driven motor, thereby controlling the distribution concentration of phosphorus atoms (P) to be contained in the layer formed.

In the manner as described above, there is first formed a layer region (P, O) containing phosphorus atoms and oxygen atoms on the support 1337.

During this operation, introduction of $PH_3$/He into the reaction chamber 1301 can be shut out by closing of the valves of the corresponding gas inlet tube, whereby the layer thickness of the layer region containing phosphorus can freely be controlled as desired.

After the layer region (P, O) containing phosphorus atoms and oxygen atoms has been formed to a desired thickness as described above, the outflow valve 1319 is closed and glow discharging is subsequently continued for a desired period of time to result in formation of a layer region (O) containing no phosphorus atom but containing oxygen atoms on the layer region (P, O) containing phosphorus atoms and oxygen atoms to a desired thickness, thus completing formation of the first amorphous layer (I).

In case when halogen atoms (X) are to be incorporated in the first amorphous layer (I), the gases employed for formation of the above respective layers are further added with, for example, $SiF_4$/He and delivered into the reaction chamber 1301.

Depending on the gas species chosen in formation of the amorphous layer, the layer forming speed can further be enhanced. For example, when layer formation is carried out by use of $Si_2H_6$ gas in place of $SiH_4$ gas, the layer formation speed can be enhanced to several times or more to improve productivity.

Formation of a second amorphous layer (II) on a first amorphous layer (I) may be performed by, for example, the following procedure. First, the shutter 1342 is opened. All the gas supplying valves are once closed and the reaction chamber 1301 is evacuated by full opening of the main valve 1334.

On the electrode 1341 on which a high voltage power is to be applied, there are previously provided targets having arranged a high purity silicon wafer 1342-1 and a high purity graphite wafer 1342-2 at a desired area ratio. From the gas bomb 1306, $SiF_4$/He gas is introduced into the reaction chamber 1301, and the main valve 1334 is adjusted so that the inner pressure in the reaction chamber may become 0.05 to 1 Torr. The high voltage power source is turned on and the targets are subjected to sputtering, whereby a second amorphous layer (II) can be formed on a first amorphous layer (I).

As another method for formation of a second amorphous layer (II), according to the same valve operation as in case of formation of the first amorphous layer (I), by, for example, permitting $SiH_4$ gas, $SiF_4$ gas and $C_2H_4$ gas, optionally diluted with a diluting gas such as He, to flow into the reaction chamber 1301, respectively, and exciting glow discharging in said chamber following the desired conditions.

The outflow valves for gases other than those necessary for formation of respective layers are all closed as a matter of course, and during formation of respective layers, in order to avoid remaining of gases employed formation of the previous layer in the pipelines from the outflow valves 1317–1321 to the reaction chamber 1301, there may be performed the operation to once evacuate the system to high vacuum by closing the outflow valves 1317–1321 and opening the auxiliary valve 1332, with full opening of the main valve 1334.

The content of carbon atoms to be contained in the second amorphous layer (II) can be controlled as desired by, for example, varying the flow rate ratio of $SiH_4$ gas:$C_2H_4$ gas to be introduced into the reaction chamber 1301, or, when layer formation is effected by sputtering, by varying the sputter area ratio of silicon wafer to graphite wafer when forming a target or by varying the mixing ratio of silicon powder to graphite powder in molding of a target.

The content of halogen atoms (X) to be contained in the second amorphous layer (II) may be controlled by controlling the flow rate of a starting gas for introduction of halogen atoms, for example, $SiF_4$ gas into the reaction chamber 1301.

The photoconductive member of the present invention designed to have layer constitution as described above can overcome all of the problems as mentioned above and exhibit very excellent electrical, optical, photoconductive characteristics, as well as good environmental characteristics in use.

In particular, when it is applied as an image forming member for electrophotography, it is excellent in charge retentivity in charging treatment without any influence of residual potential on image formation at all, being stable in its electrical properties with high sensitivity and having high SN ratio as well as excellent light fatigue resistance and repeated usage characteristics, whereby it is possible to obtain images of high quality with high concentration, clear halftone and high resolution.

EXAMPLE 1

By means of the device as shown in FIG. 12, layers were formed on a cylindrical aluminum substrate with the content of phosphorus (P) in the layer as a parameter. The common conditions are shown in Table 1A below. Table 2A shows the distribution concentrations of phosphorus contained in the amorphous layer at respective positions in the direction of the layer thickness from the substrate surface and the results of evaluations of the electrophotographic characteristics of the samples obtained.

In Table 2A, the figures on the left column indicate sample numbers.

The image forming members for electrophotography prepared were evaluated comprehensively by superiority or inferiority of density, resolution and halftone reproducibility of the image visualized on a transfer paper after a series of electrophotographic process of charging-imagewise exposure-development-transfer.

TABLE 1A

| Layer constitution | | Conditions: Gases employed | Flow rate (SCCM) | Flow rate ratio | Layer formation speed (Å/S) | Discharging power (W/cm²) | Substrate temperature (°C.) | Pressure during reaction (Torr) | Discharging frequency (MHz) |
|---|---|---|---|---|---|---|---|---|---|
| Amorphous layer | Layer region (V) | $SiH_4$/He = 1<br>$PH_3$/He = $1 \times 10^{-2}$<br>NO | $SiH_4$ = 200 | $PH_3/SiH_4$ = Suitably changed<br>$NO/SiH_4 = 3 \times 10^{-2}$ | 16 | 0.2 | 250 | 0.5 | 13.56 |
| | Layer region (B) | $SiH_4$/He = 1<br>NO | $SiH_4$ = 200 | $NO/SiH_4 = 3 \times 10^{-2}$ | " | " | " | " | " |

Thickness of layer region (B) T = 20μ

TABLE 2A

| Sample No. | Position from the substrate surface (μ): 0 | 0.1 | 0.2 | 0.5 | 1.0 | 2.0 | 3.0 | 4.0 | 5.0 | Evaluation |
|---|---|---|---|---|---|---|---|---|---|---|
| A101 | 100 | 100 | 100 | 100 | 65 | 20 | 10 | 10 | 10 | ○ |
| A102 | 200 | 200 | 200 | 120 | 75 | 0 | 0 | 0 | 0 | ○ |
| A103 | 200 | 200 | 95 | 86 | 76 | 34 | 15 | 10 | 10 | ◎ |
| A104 | 200 | 180 | 165 | 130 | 96 | 27 | 12 | 10 | 10 | ◎ |
| A105 | 300 | 270 | 240 | 172 | 116 | 0 | 0 | 0 | 0 | ○ |
| A106 | 500 | 390 | 200 | 75 | 25 | 12 | 10 | 10 | 10 | ◎ |
| A107 | 100 | 100 | 99 | 97 | 96 | 77 | 55 | 32 | 10 | Δ |
| A108 | 200 | 200 | 200 | 98 | 96 | 78 | 55 | 32 | 10 | ○ |
| A109 | 200 | 200 | 200 | 49 | 48 | 39 | 29 | 20 | 10 | ◎ |
| A111 | 100 | 99 | 99 | 97 | 95 | 75 | 50 | 25 | 0 | ○ |
| A112 | 200 | 198 | 196 | 190 | 180 | 100 | 0 | 0 | 0 | Δ |
| A113 | 200 | 180 | 160 | 100 | 0 | 0 | 0 | 0 | 0 | ○ |
| A114 | 500 | 250 | 0 | 0 | 0 | 0 | 0 | 0 | 0 | ○ |
| A115 | 500 | 250 | 10 | 10 | 10 | 10 | 10 | 10 | 10 | ◎ |
| A116 | 100 | 90 | 85 | 55 | 10 | 10 | 10 | 10 | 10 | ○ |

The values in the Table indicate respective distribution concentrations (atomic ppm) of phosphorus.

◎; Excellent

○; Good

Δ; Practically useful.

EXAMPLE 2

Image forming members for electrophotography having the same layer constitutions as the samples shown in Example 1 (No. A 101–No. A 116) were prepared by using $Si_2H_6$/He gas in place of $SiH_4$/He gas under the conditions as shown in Table 3A, and evaluated similarly. The results are shown in Table 4A.

In Table 4A, No. A 201 means a sample having a layer constitution equal to that of No. A 101 in Table 2A. (The same is the case with all of the samples No. A 202 et seq.).

TABLE 3A

| Layer constitution | | Conditions: Gases employed | Flow rate (SCCM) | Flow rate ratio | Layer formation speed (Å/S) | Discharging power ($W/cm^2$) | Substrate temperature (°C.) | Pressure during reaction (Torr) | Discharging frequency (MHz) |
|---|---|---|---|---|---|---|---|---|---|
| Amorphous layer | Layer region (V) | $Si_2H_6/He = 1$ $PH_3/He = 1 \times 10^{-2}$ NO | $SiH_4 = 200$ | $PH_3/Si_2H_6$ = Suitably changed $NO/Si_2H_6 = 3 \times 10^{-2}$ | 50 | 1 | 250 | 0.5 | 13.56 |
| | Layer region (B) | $Si_2H_6/He = 1$ NO | $SiH_4 = 200$ | $NO/Si_2H_6 = 3 \times 10^{-2}$ | " | " | " | " | " |

Thickness of layer region (B) T = 20μ

TABLE 4A

| Sample No. | A 201 | A 202 | A 203 | A 204 | A 205 | A 206 | A 207 | A 208 | A 209 | A 210 | A 211 | A 212 | A 213 | A 214 | A 215 |
|---|---|---|---|---|---|---|---|---|---|---|---|---|---|---|---|
| Evaluation | ◯ | ◯ | ◎ | ◎ | ○ | ◎ | △ | ○ | ◎ | ○ | △ | ○ | ○ | ◎ | ○ |

EXAMPLE 3

Image forming members for electrophotography were prepared having the same layer constitutions as Sample Nos. A 103, A 104, A 106, A 109 and A 115 among the samples in Example 1 by use of $SiF_4$/He gas in addition to $SiH_4$/He gas. During these operations, the mixing ratio of $SiH_4$ gas to $SiF_4$ gas was made such that $[SiF_4/(SiH_4+SiF_4)]$may be 30 vol. %, following otherwise the same preparation conditions and the procedures as in Example 1. The thus obtained image forming members were employed for image formation on transfer papers under a series of electrophotographic processes and evaluated similarly as in Example 1. As the result, the image formed in each sample was found to have a high density as well as a high resolution, being also excellent in halftone reproducibility.

EXAMPLE 4

Image forming members were prepared according to entirely the same procedures under the same conditions as in Example 1 and Example 2, respectively, except that, during formation of the layer regions (B) in Examples 1 and 2, the layer forming conditions were changed to the conditions 1, 2 and 4, among those shown in Table 5A below respectively, in case of Example 1, and to the condition 1, in case of Example 2, and evaluated according to the same method as in Example 1. As the result, good results were obtained with respect to image quality and durability for respective samples.

TABLE 5 A

| Conditions | Gases employed | Flow rate (SCCM) | Flow rate ratio | Layer thickness (μ) |
|---|---|---|---|---|
| 1 | $SiH_4/He = 1$ $B_2H_6/He = 1 \times 10^{-2}$ NO | $SiH_4 = 200$ | $B_2H_6/SiH_4 = 2 \times 10^{-5}$ $NO/SiH_4 = 3 \times 10^{-2}$ | 15 |
| 2 | $SiH_4/He = 1$ $B_2H_6/He = 1 \times 10^{-2}$ NO | $SiH_4 = 200$ | $B_2H_6/SiH_4 = 1 \times 10^{-5}$ $NO/SiH_4 = 3 \times 10^{-2}$ | 15 |
| 3 | $Si_2H_6/He = 1$ $B_2H_6/He = 1 \times 10^{-2}$ NO | $Si_2H_6 = 170$ | $B_2H_6/Si_2H_6 = 3 \times 10^{-4}$ $NO/Si_2H_6 = 3 \times 10^{-2}$ | 10 |
| 4 | $SiH_4/He = 1$ $SiF_4/He = 1$ $B_2H_6/He = 1 \times 10^{-2}$ NO | $(SiH_4 + SiF_4) = 100$ | $SiH_4/SiF_4 = 8/2$ $B_2H_6/(SiH_4 + SiF_4) = 2 \times 10^{-5}$ $NO/(SiH_4 + SiF_4) = 3 \times 10^{-2}$ | 15 |

EXAMPLE 5

By means of the device as shown in FIG. 13, layers were formed on a cylindrical aluminum substrate with the content of phosphorus (P) in the layer region (V) as a parameter. The common conditions are shown in Table 1B below. Table 2B shows the distribution concentrations of phosphorus contained in the layer region (V) constituting the first amorphous layer (I) at respective positions in the direction of the layer thickness from the substrate surface and the results of evaluations of the electrophotographic characteristics of the samples obtained.

In Table 2B, the figures on the left column indicate sample numbers.

The image forming members prepared were evaluated comprehensively by superiority or inferiority of density, resolution and halftone reproducibility of the image visualized on a transfer paper after a series of electrophotographic process of charging-imagewise exposure-development-transfer.

TABLE 1B

| Layer constitution | | Conditions: Gases employed | Flow rate (SCCM) | Flow rate ratio | Discharging power (W/cm²) | Layer thickness |
|---|---|---|---|---|---|---|
| Amorphous layer (I) | Layer region (V) | $SiH_4/He$ = 1<br>$PH_3/He$ = $10^{-2}$<br>NO | $SiH_4$ = 200 | $PH_3/SiH_4$ = Suitably changed<br>$NO/SiH_4 = 3 \times 10^{-2}$ | 0.18 | Suitably changed |
| | Layer region (B) | $SiH_4/He$ = 1<br>NO | $SiH_4$ = 200 | $NO/SiH_4 = 3 \times 10^{-2}$ | 0.18 | 20μ |
| Amorphous layer (II) | | Ar | 200 | Si wafer: graphite = 1.5:8.5 (Area ratio) | 0.3 | 0.5μ |

Al substrate temperature: 250° C.
Discharging frequency: 13.56 MHz
Inner pressure in reaction chamber: Amorphous layer (I) 0.3 Torr; Amorphous layer (II) 0.2 Torr

TABLE 2B

| Sample No. | Position from the substrate surface (μ): 0 | 0.1 | 0.2 | 0.5 | 1.0 | 2.0 | 3.0 | 4.0 | 5.0 | Evaluation |
|---|---|---|---|---|---|---|---|---|---|---|
| B101 | 100 | 100 | 100 | 100 | 65 | 20 | 10 | 10 | 10 | ○ |
| B102 | 200 | 200 | 200 | 120 | 75 | 0 | 0 | 0 | 0 | ○ |
| B103 | 200 | 200 | 95 | 86 | 76 | 34 | 15 | 10 | 10 | ◎ |
| B104 | 200 | 180 | 165 | 130 | 96 | 27 | 12 | 10 | 10 | ◎ |
| B105 | 300 | 270 | 240 | 172 | 116 | 0 | 0 | 0 | 0 | ○ |
| B106 | 500 | 390 | 200 | 75 | 25 | 12 | 10 | 10 | 10 | ◎ |
| B107 | 100 | 100 | 99 | 97 | 96 | 77 | 55 | 32 | 10 | Δ |
| B108 | 200 | 200 | 200 | 98 | 96 | 78 | 55 | 32 | 10 | ○ |
| B109 | 200 | 200 | 200 | 49 | 48 | 39 | 29 | 20 | 10 | ◎ |
| B111 | 100 | 99 | 99 | 97 | 95 | 75 | 50 | 25 | 0 | ○ |
| B112 | 200 | 198 | 196 | 190 | 180 | 100 | 0 | 0 | 0 | Δ |
| B113 | 200 | 180 | 160 | 100 | 0 | 0 | 0 | 0 | 0 | ○ |
| B114 | 500 | 250 | 0 | 0 | 0 | 0 | 0 | 0 | 0 | ○ |
| B115 | 500 | 250 | 10 | 10 | 10 | 10 | 10 | 10 | 10 | ◎ |
| B116 | 100 | 90 | 85 | 55 | 10 | 10 | 10 | 10 | 10 | ○ |

The values in the table indicate respective distribution concentrations (atomic ppm) of phosphorus.

◎; Excellent
○; Good
Δ; Practically useful.

EXAMPLE 6

Image forming members for electrophotography having the same layer constitutions as the samples shown in Example 5 (No. B 101–No. B 116) were prepared by using $Si_2H_6/He$ gas in place of $SiH_4/He$ gas under the conditions as shown in Table 3B, and evaluated similarly. The results are shown in Table 4B.

In Table 4B, No. B 201 means a sample having a layer constitution equal to that of No. B 101 in Table 2B. (The same is the case with all of the samples No. B 202 et seq.).

TABLE 3B

| Layer constitution | | Conditions: Gases employed | Flow rate (SCCM) | Flow rate ratio | Layer formation speed (Å/S) | Discharging power (W/cm²) | Pressure during reaction (Torr) |
|---|---|---|---|---|---|---|---|
| Amorphous layer (I) | Layer region (V) | $Si_2H_6/He$ = 1<br>$PH_3/He$ = $1 \times 10^{-2}$<br>NO | $Si_2H_6$ = 200 | $PH_3/Si_2H_6$ = Suitably changed<br>$NO/Si_2H_6 = 3 \times 10^{-2}$ | 50 | 1 | 0.5 |
| | Layer region (B) | $Si_2H_6/He$ = 1<br>NO | $Si_2H_6$ = 200 | $NO/Si_2H_6 = 3 \times 10^{-2}$ | " | " | " |

TABLE 4B

| Sample No. | B 201 | B 202 | B 203 | B 204 | B 205 | B 206 | B 207 | B 208 | B 209 | B 210 | B 211 | B 212 | B 213 | B 214 | B 215 |
|---|---|---|---|---|---|---|---|---|---|---|---|---|---|---|---|
| Evaluation | ○ | ○ | ◎ | ◎ | ○ | ◎ | Δ | ○ | ◎ | ○ | Δ | ○ | ○ | ◎ | ○ |

EXAMPLE 7

Image forming members for electrophotography were prepared having the same layer constitutions as Sample Nos. B 103, B 104, B 106, B 109 and B 115 among the samples in Example 5 by use of $SiF_4/He$ gas in addition to $SiH_4/He$ gas. During these operations, the mixing ratio of $SiH_4$ gas to $SiF_4$ gas was made such that $[SiF_4/(SiH_4+SiF_4)]$ may be 30 vol. %, following otherwise the same preparation conditions and the procedures as in Example 5. The thus obtained image forming members were employed for image formation on transfer papers under a series of electrophotographic processes and evaluated similarly as in Example 5. As the result, the image formed in each sample was found to have a high density as well as a high resolution, being also excellent in halftone reproducibility.

EXAMPLE 8

Image forming members were prepared according to entirely the same procedures under the same conditions as in Example 5 and Example 6, respectively, except that, during formation of the layer regions (B) in Examples 5 and 6, the layer forming conditions were changed to the conditions 1, 2 and 4, among those shown in Table 5B below respectively, in case of Example 5, and to the condition 3, in case of Example 6, and evaluated according to the same method as in Example 5. As the result, good results were obtained with respect to image quality and durability for respective samples.

TABLE 5B

| Conditions | Gases employed | Flow rate (SCCM) | Flow rate ratio | Layer thickness (μ) |
|---|---|---|---|---|
| 1 | $SiH_4/He = 1$<br>$B_2H_6/He = 1 \times 10^{-2}$<br>NO | $SiH_4 = 200$ | $B_2H_6/SiH_4 = 2 \times 10^{-5}$<br>$NO/SiH_4 = 3 \times 10^{-2}$ | 15 |
| 2 | $SiH_4/He = 1$<br>$B_2H_6/He = 1 \times 10^{-2}$<br>NO | $SiH_4 = 200$ | $B_2H_6/SiH_4 = 1 \times 10^{-5}$<br>$NO/SiH_4 = 3 \times 10^{-2}$ | 15 |
| 3 | $Si_2H_6/He = 1$<br>$B_2H_6/He = 1 \times 10^{-2}$<br>NO | $Si_2H_6 = 170$ | $B_2H_6/Si_2H_6 = 3 \times 10^{-4}$<br>$NO/Si_2H_6 = 3 \times 10^{-2}$ | 10 |
| 4 | $SiH_4/He = 1$<br>$SiF_4/He = 1$<br>$B_2H_6/He = 1 \times 10^{-2}$<br>NO | $SiH_4 + SiF_4 = 100$ | $SiH_4/SiF_4 = 8/2$<br>$B_2H_6/(SiH_4 + SiF_4) = 2 \times 10^{-5}$<br>$NO/(SiH_4 + SiF_4) = 3 \times 10^{-2}$ | 15 |

EXAMPLE 9

Image forming members for electrophotography were prepared by following the same conditions and procedures as in Examples 5 and 6, respectively, except that the conditions for preparation of the amorphous layer (II) were changed to the respective conditions as shown in Table 6B below.

The image forming members thus obtained were set in a charging-exposure-developing device, subjected to corona charging at ⊖5.0 kV for 0.2 sec, followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was subjected once to cleaning with a rubber blade, and the above image making-cleaning step was repeated again. Even after a repetition number of 100,000 or more, no deterioration of image was observed in any of the image forming members for electrophotography.

TABLE 6B

| Conditions | Gases employed | Flow rate (SCCM) | Target area ratio Si wafer:graphite | Discharging power (W/cm²) | Layer thickness (μ) |
|---|---|---|---|---|---|
| 1 | Ar | 200 | 0.5:9.5 | 0.3 | 0.3 |
| 2 | Ar | 200 | 6:4 | 0.3 | 1.0 |

EXAMPLE 10

Image forming members (Sample No. B 601–B 649) were prepared according to the same method as in case of Sample Nos. B 102, B 104, B 105, B 106, B 109, B 113 and B 114, respectively, in Example 5, except that the content ratio of silicon atoms to carbon atoms was varied in the amorphous layer (II) by varying the area ratio of silicon wafer to graphite during formation of the amorphous layer (II). For each of the thus prepared image forming members, the steps of image making, development and cleaning as described in Example 5 were repeated for about 50,000 times, followed by image evaluation, to obtain the results as shown in Table 7B.

TABLE 7B

| Sample No. | B 601 | B 602 | B 603 | B 604 | B 605 | B 606 | B 607 |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality | Δ | ○ | ◎ | ◎ | ○ | Δ | X |

TABLE 7B-continued

| Sample No. | B 601 | B 602 | B 603 | B 604 | B 605 | B 606 | B 607 |
|---|---|---|---|---|---|---|---|
| evaluation | | | | | | | |

◎: Very good
○: Good
Δ: Practically satisfactory
X: Image defect slightly formed

EXAMPLE 11

The respective image forming members (Sample No. B 701–B 704) were prepared according to the same method as in preparation of the Sample No. B 103 in Example 5, except that the layer thickness of the amorphous layer (II) was varied. For each sample, the steps of image-making, development and cleaning as described in Example 5 were repeated to obtain the results shown below.

TABLE 8B

| Sample No. | Thickness of amorphous layer (II) (μ) | Results |
|---|---|---|
| B 701 | 0.001 | Image defect liable to occur. |
| B 702 | 0.02 | No image defect during 20,000 repetitions. |
| B 703 | 0.05 | Stable for 50,000 repetitions or more. |
| B 704 | 1 | Stable for 200,000 repetitions or more. |

EXAMPLE 12

By means of the device as shown in FIG. 13, layers were formed on a cylindrical aluminum substrate with the content of phosphorus (P) in the layer region (V) as a parameter. The common conditions are shown in Table 1C below. Table 2C shows the distribution concentrations of phosphorus contained in the layer region (V) constituting the first amorphous layer (I) at respective positions in the direction of the layer thickness from the substrate surface and the results of evaluations of the electrophotographic characteristics of the samples obtained.

In Table 2C, the figures on the left column indicate sample numbers.

The image forming members prepared were evaluated comprehensively superiority or inferiority of density, resolution and halftone reproducibility of the image visualized on a transfer paper after a series of electrophotographic process of charging-imagewise exposure-development-transfer.

TABLE 1C

| Layer constitution | | Conditions: Gases employed | Flow rate (SCCM) | Flow rate ratio | Discharging power ($W/cm^2$) | Layer thickness |
|---|---|---|---|---|---|---|
| Amorphous layer (I) | Layer region (V) | $SiH_4/He$ = 1<br>$PH_3/He$ = $1 \times 10^{-2}$<br>NO | $SiH_4$ = 200 | $PH_3/SiH_4$ = Suitably changed<br>$NO/SiH_4 = 3 \times 10^{-2}$ | 0.18 | Suitably changed |
| | Layer region (B) | $SiH_4/He$ = 1<br>NO | $SiH_4$ = 200 | $NO/SiH_4 = 3 \times 10^{-2}$ | 0.18 | 20μ |
| Amorphous layer (II) | | $SiH_4/He$ = 0.5<br>$C_2H_4$ | $SiH_4$ = 100 | $SiH_4:C_2H_4$ = 3:7 | 0.18 | 0.5μ |

| | |
|---|---|
| Al substrate temperature: | 250° C. |
| Discharging frequency: | 13.56 MHz |
| Inner pressure in reaction chamber: | Amorphous layer (I) 0.3 Torr<br>Amorphous layer (II) Torr |

TABLE 2C

| Sample No. | Position from the substrate surface (μ): 0 | 0.1 | 0.2 | 0.5 | 1.0 | 2.0 | 3.0 | 4.0 | 5.0 | Evaluation |
|---|---|---|---|---|---|---|---|---|---|---|
| C101 | 100 | 100 | 100 | 100 | 65 | 20 | 10 | 10 | 10 | ○ |
| C102 | 200 | 200 | 200 | 120 | 75 | 0 | 0 | 0 | 0 | ○ |
| C103 | 200 | 200 | 95 | 86 | 76 | 34 | 15 | 10 | 10 | ◎ |
| C104 | 200 | 180 | 165 | 130 | 96 | 27 | 12 | 10 | 10 | ◎ |
| C105 | 300 | 270 | 240 | 172 | 116 | 0 | 0 | 0 | 0 | ○ |
| C106 | 500 | 390 | 200 | 75 | 25 | 12 | 10 | 10 | 10 | ◎ |
| C107 | 100 | 100 | 99 | 97 | 96 | 77 | 55 | 32 | 10 | Δ |
| C108 | 200 | 200 | 200 | 98 | 96 | 78 | 55 | 32 | 10 | ○ |
| C109 | 200 | 200 | 200 | 49 | 48 | 39 | 29 | 20 | 10 | ◎ |
| C111 | 100 | 99 | 99 | 97 | 95 | 75 | 50 | 25 | 0 | ○ |
| C112 | 200 | 198 | 196 | 190 | 180 | 100 | 0 | 0 | 0 | Δ |
| C113 | 200 | 180 | 160 | 100 | 0 | 0 | 0 | 0 | 0 | ○ |
| C114 | 500 | 250 | 0 | 0 | 0 | 0 | 0 | 0 | 0 | ○ |
| C115 | 500 | 250 | 10 | 10 | 10 | 10 | 10 | 10 | 10 | ◎ |
| C116 | 100 | 90 | 85 | 55 | 10 | 10 | 10 | 10 | 10 | ○ |

The values in the table indicate respective distribution concentrations (atomic ppm) of phosphorus.

◎; Excellent
○; Good
Δ; Practically useful.

EXAMPLE 13

Image forming members for electrophotography having the same layer constitutions as the samples shown in Example 12 (No. C 101–No. C 116) were prepared by using $Si_2H_6/He$ gas in place of $SiH_4/He$ gas under the conditions as shown in Table 3C, and evaluated similarly. The results are shown in Table 4C.

In Table 4C, No. C 201 means a sample having a layer constitution equal to that of No. C 101 in Table 2C.

(The same is the case with all of the samples No. C 202 et seq.).

TABLE 3C

| Layer constitution | | Conditions: Gases employed | Flow rate (SCCM) | Flow rate ratio | Layer formation speed (Å/S) | Discharging power (W/cm²) | Pressure during reaction (Torr) |
|---|---|---|---|---|---|---|---|
| Amorphous layer (I) | Layer region (V) | $Si_2H_6$/He = 1<br>$PH_3$/He = $1 \times 10^{-2}$<br>NO | $Si_2H_6$ = 200 | $PH_3/Si_2H_6$ = Suitably changed<br>$NO/Si_2H_6 = 3 \times 10^{-2}$ | 50 | 1 | 0.5 |
| | Layer region (B) | $Si_2H_6$/He = 1<br>NO | $Si_2H_6$ = 200 | $NO/Si_2H_6 = 3 \times 10^{-2}$ | " | " | " |

TABLE 4C

| Sample No. | C 201 | C 202 | C 203 | C 204 | C 205 | C 206 | C 207 | C 208 | C 209 | C 210 | C 211 | C 212 | C 213 | C 214 | C 215 |
|---|---|---|---|---|---|---|---|---|---|---|---|---|---|---|---|
| Evaluation | ○ | ○ | ◎ | ◎ | ○ | ◎ | Δ | ○ | ◎ | ○ | Δ | ○ | ○ | ◎ | ○ |

EXAMPLE 14

Image forming members for electrophotography were prepared having the same layer constitutions as Sample Nos. C 103, C 104, C 106, C 109 and C 115 among the samples in Example 12 by use of $SiF_4$/He gas in addition to $SiH_4$/He gas. During these operations, the mixing ratio of $SiH_4$ gas to $SiF_4$ gas was made such that [$SiF_4/(SiH_4+SiF_4)$] may be 30 vol. %, following otherwise the same preparation conditions and the procedures as in Example 12. The thus obtained image forming members were employed for image formation on transfer papers under a series of electrophotographic processes and evaluated similarly as in Example 12. As the result, the image formed in each sample was found to have a high density as well as a high resolution, being also excellent in halftone reproducibility.

EXAMPLE 15

Image forming members were prepared according to entirely the same procedures under the same conditions as in Example 12 and Example 13, respectively, except that, during formation of the layer regions(B) in Examples 12 and 13, the layer forming conditions were changed to the conditions 1, 2 and 4, among those shown in Table 5C below respectively, in case of Example 12, and to the condition 3, in case of Example 13, and evaluated according to the same method as in Example 12. As the result, good results were obtained with respect to image quality and durability for respective samples.

TABLE 5C

| Conditions | Gases employed | Flow rate (SCCM) | Flow rate ratio | Layer thickness (μ) |
|---|---|---|---|---|
| 1 | $SiH_4$/He = 1<br>$B_2H_6$/He = $1 \times 10^{-2}$<br>NO | $SiH_4$ = 200 | $B_2H_6/SiH_4 = 2 \times 10^{-5}$<br>$NO/SiH_4 = 3 \times 10^{-2}$ | 15 |
| 2 | $SiH_4$/He = 1<br>$B_2H_6$/He = $1 \times 10^{-2}$<br>NO | $SiH_4$ = 200 | $B_2H_6/SiH_4 = 1 \times 10^{-5}$<br>$NO/SiH_4 = 3 \times 10^{-2}$ | 15 |
| 3 | $Si_2H_6$/He = 1<br>$B_2H_6$/He = $1 \times 10^{-2}$<br>NO | $Si_2H_6$ = 170 | $B_2H_6/Si_2H_6 = 3 \times 10^{-4}$<br>$NO/Si_2H_6 = 3 \times 10^{-2}$ | 10 |
| 4 | $SiH_4$/He = 1<br>$SiF_4$/He = 1<br>$B_2H_6$/He = $1 \times 10^{-2}$<br>NO | $SiH_4 + SiF_4$ = 100 | $SiH_4:SiF_4$ = 8:2<br>$B_2H_6/(SiH_4 + SiF_4) = 2 \times 10^{-5}$<br>$NO/(SiH_4 + SiF_4) = 3 \times 10^{-2}$ | 15 |

EXAMPLE 16

Image forming members for electrophotography were prepared by following the same conditions and procedures as in Examples 12 and 13, respectively, except that the conditions for preparation of the amorphous layer (II) were changed to the respective conditions as shown in Table 6C below.

The image forming members thus obtained were set in a charging-exposure-developing device, subjected to corona charging at ⊖5.0 kV for 0.2 sec, followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was subjected once to cleaning with a rubber blade, and the above image making-cleaning step was repeated again. Even after a repetition number of 100,000 or more, no deterioration of image was observed in any of the image forming members for electrophotography.

TABLE 6C

| Conditions | Gases employed | Flow rate (SCCM) | Flow rate ratio | Discharging power ($W/cm^2$) | Layer thickness |
|---|---|---|---|---|---|
| 1 | $SiH_4/He = 1$ $C_2H_4$ | $SiH_4 =$ 15 | $SiH_4:C_2H_4 =$ 0.4:9.6 | 0.18 | 0.3μ |
| 2 | $SiH_4/He = 0.5$ $C_2H_4$ | $SiH_4 =$ 100 | $SiH_4:C_2H_4 =$ 5:5 | 0.18 | 1.5μ |

EXAMPLE 17

Image forming members (Sample No. C 601–C 649) were prepared according to the same method as in case of Sample Nos. C 102, C 104, C 105, C 106, C 109, C 113 and C 114, respectively, in Example 12, except that the content ratio of silicon atoms to carbon atoms was varied in the amorphous layer (II) by varying the flow rate ratio of $SiH_4$ gas to $C_2H_4$ gas during formation of the amorphous layer (II). For each of the thus prepared image forming members, the steps of image making, development and cleaning as described in Example 12 were repeated for about 50,000 times, followed by image evaluation, to obtain the results as shown in Table 7C.

TABLE 7C

| Sample No. | C 601 | C 602 | C 603 | C 604 | C 605 | C 606 | C 607 | C 609 |
|---|---|---|---|---|---|---|---|---|
| $SiH_4:C_2H_4$ (Flow rate ratio) | 9:1 | 6:4 | 4:6 | 2:8 | 1:9 | 0.5:9.5 | 0.35:9.65 | 0.2:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | X |

◎ : Very good
○ : Good
Δ: Practically satisfactory
X: Image defect slightly formed

EXAMPLE 18

The respective image forming members (Sample No. C 701–C 704) were prepared according to the same method as in preparation of the Sample No. C 103 in Example 12, except that the layer thickness of the amorphous layer (II) was varied. For each sample, the steps of image-making, development and cleaning as described in Example 12 were repeated to obtain the results shown below.

TABLE 8C

| Sample No. | Thickness of amorphous layer (II) (μ) | Results |
|---|---|---|
| C 701 | 0.001 | Image defect liable to occur. |

TABLE 8C-continued

| Sample No. | Thickness of amorphous layer (II) (μ) | Results |
|---|---|---|
| C 702 | 0.02 | No image defect during 20,000 repetitions. |
| C 703 | 0.05 | Stable even for 50,000 repetitions or more. |
| C 704 | 1 | Stable even for 200,000 repetitions or more. |

EXAMPLE 19

By means of the device as shown in FIG. 13, layers were formed on a cylindrical aluminum substrate with the content of phosphorus (P) in the layer region (V) as a parameter. The common conditions are shown in Table 1D below. Table 2D shows the distribution concentrations of phosphorus contained in the layer region (V) constituting the first amorphous layer (I) at respective positions in the direction of the layer thickness from the substrate surface and the results of evaluations of the electrophotographic characteristics of the samples obtained.

In Table 2D, the figures on the left column indicate sample numbers.

The image forming members prepared were evaluated comprehensively by superiority or inferiority of density, resolution and halftone reproducibility of the image visualized on a transfer paper after a series of electrophotographic process of charging-imagewise exposure-development-transfer.

TABLE 1D

| layer constitution | | Conditions: Gases employed | Flow rate (SCCM) | Flow rate ratio | Discharging power ($W/cm^2$) | Layer thickness |
|---|---|---|---|---|---|---|
| Amorphous layer (I) | Layer region (V) | $SiH_4/He =$ 1 $PH_3/He = 10^{-2}$ NO | $SiH_4 =$ 200 | $PH_3/SiH_4 =$ Suitably changed $NO/SiH_4 = 3 \times 10^{-2}$ | 0.18 | Suitably changed |
| | Layer region | $SiH_4/He =$ 1 | $SiH_4 =$ 200 | $NO/SiH_4 = 3 \times 10^{-2}$ | 0.18 | 20μ |

TABLE 1D-continued

| layer constitution | Conditions: Gases employed | Flow rate (SCCM) | Flow rate ratio | Discharging power (W/cm²) | Layer thickness |
|---|---|---|---|---|---|
| (B) Amorphous layer (II) | NO $SiH_4/He$ = 0.5 $SiF_4/He$ = 0.5 $C_2H_4$ | $SiH_4$ + $SiF_4$ = 150 | $SiH_4:SiF_4:C_2H_4$ = 1.5:1.5:7 | 0.18 | 0.5μ |

| | |
|---|---|
| Al substrate temperature: | 250° C. |
| Discharging frequency: | 13.56 MHz |
| Inner pressure in reaction chamber: | Amorphous layer (I) 0.3 Torr<br>Amorphous layer (II) 0.2 Torr |

TABLE 2D

| Sample No. | Position from the substrate surface (μ): 0 | 0.1 | 0.2 | 0.5 | 1.0 | 2.0 | 3.0 | 4.0 | 5.0 | Evaluation |
|---|---|---|---|---|---|---|---|---|---|---|
| D101 | 100 | 100 | 100 | 100 | 65 | 20 | 10 | 10 | 10 | ○ |
| D102 | 200 | 200 | 200 | 120 | 75 | 0 | 0 | 0 | 0 | ○ |
| D103 | 200 | 200 | 95 | 86 | 76 | 34 | 15 | 10 | 10 | ◎ |
| D104 | 200 | 180 | 165 | 130 | 96 | 27 | 12 | 10 | 10 | ◎ |
| D105 | 300 | 270 | 240 | 172 | 116 | 0 | 0 | 0 | 0 | ○ |
| D106 | 500 | 390 | 200 | 75 | 25 | 12 | 10 | 10 | 10 | ◎ |
| D107 | 100 | 100 | 99 | 97 | 96 | 77 | 55 | 32 | 10 | Δ |
| D108 | 200 | 200 | 200 | 98 | 96 | 78 | 55 | 32 | 10 | ○ |
| D109 | 200 | 200 | 200 | 49 | 48 | 39 | 29 | 20 | 10 | ◎ |
| D111 | 100 | 99 | 99 | 97 | 95 | 75 | 50 | 25 | 0 | ○ |
| D112 | 200 | 198 | 196 | 190 | 180 | 100 | 0 | 0 | 0 | Δ |
| D113 | 200 | 180 | 160 | 100 | 0 | 0 | 0 | 0 | 0 | ○ |
| D114 | 500 | 250 | 0 | 0 | 0 | 0 | 0 | 0 | 0 | ○ |
| D115 | 500 | 250 | 10 | 10 | 10 | 10 | 10 | 10 | 10 | ◎ |
| D116 | 100 | 90 | 85 | 55 | 10 | 10 | 10 | 10 | 10 | ○ |

The values in the table indicate respective distribution concentrations (atomic ppm) of phosphorus.

◎; Excellent

○; Good

Δ; Practically useful.

EXAMPLE 20

Image forming members for electrophotography having the same layer constitutions as the samples shown in Example 19 (No. D 101–No. D 116) were prepared by using $Si_2H_6/He$ gas in place of $SiH_4/He$ gas under the conditions as shown in Table 3D, and evaluated similarly. The results are shown in Table 4D.

In Table 4D, No. D 201 means a sample having a layer constitution equal to that of No. D 101 in Table 2D. (The same is the case with all of the samples No. D 202 et seq.).

TABLE 3D

| Layer constitution | | Conditions: Gases employed | Flow rate (SCCM) | Flow rate ratio | Layer formation speed (Å/S) | Discharging power (W/cm²) | Pressure during reaction (Torr) |
|---|---|---|---|---|---|---|---|
| Amorphous layer (I) | Layer region (V) | $Si_2H_6/He$ = 1 $PH_3/He$ = $1 \times 10^{-2}$ NO | $Si_2H_6$ = 200 | $PH_3/Si_2H_6$ = Suitably changed $NO/Si_2H_6$ = $3 \times 10^{-2}$ | 50 | 1 | 0.5 |
| | Layer region (B) | $Si_2H_6/He$ = 1 NO | $Si_2H_6$ = 200 | $NO/Si_2H_6$ = $3 \times 10^{-2}$ | " | " | " |

TABLE 4D

| Sample No. | D 201 | D 202 | D 203 | D 204 | D 205 | D 206 | D 207 | D 208 | D 209 | D 210 | D 211 | D 212 | D 213 | D 214 | D 215 |
|---|---|---|---|---|---|---|---|---|---|---|---|---|---|---|---|
| Image quality evaluation | ○ | ○ | ◎ | ◎ | ○ | ◎ | Δ | ○ | ◎ | ○ | Δ | ○ | ○ | ◎ | ○ |

EXAMPLE 21

Image forming members for electrophotography were prepared having the same layer constitutions as Sample Nos. D 103, D 104, D 106, D 109 and D 115 among the samples in Example 19 by use of $SiF_4/He$ gas in addition to $SiH_4/He$ gas. During these operations, the mixing ratio of $SiH_4$ gas to $SiF_4$ gas was made such that $[SiF_4/(SiH_4+SiF_4)]$ may be 30 vol. %, following otherwise the same preparation conditions and the procedures as in Example 19. The thus obtained image forming members were employed for image formation on transfer papers under a series of electrophotographic processes and evaluated similarly as in Example 19. As the result, the image formed in each sample was found to have a high density as well as a high resolution, being also excellent in halftone reproducibility.

EXAMPLE 22

Image forming members were prepared according to entirely the same procedures under the same conditions as in Example 19 and Example 20, respectively, except that, during formation of the layer regions (B) in Examples 19 and 20, the layer forming conditions were changed to the conditions 1, 2 and 4, among those shown in Table 5D below respectively, in case of Example 19, and to the condition 3, in case of Example 20, and evaluated according to the same method as in Example 19. As the result, good results were obtained with respect to image quality and durability for respective samples.

TABLE 5D

| Conditions | Gases employed | Flow rate (SCCM) | Flow rate ratio | Layer thickness (μ) |
|---|---|---|---|---|
| 1 | $SiH_4/He = 1$<br>$B_2H_6/He = 1 \times 10^{-2}$<br>NO | $SiH_4 = 200$ | $B_2H_6/SiH_4 = 2 \times 10^{-5}$<br>$NO/SiH_4 = 3 \times 10^{-2}$ | 15 |
| 2 | $SiH_4/He = 1$<br>$B_2H_6/He = 1 \times 10^{-2}$<br>NO | $SiH_4 = 200$ | $B_2H_6/SiH_4 = 1 \times 10^{-5}$<br>$NO/SiH_4 = 3 \times 10^{-2}$ | 15 |
| 3 | $Si_2H_6/He = 1$<br>$B_2H_6/He = 1 \times 10^{-2}$<br>NO | $Si_2H_6 = 170$ | $B_2H_6/Si_2H_6 = 3 \times 10^{-4}$<br>$NO/Si_2H_6 = 3 \times 10^{-2}$ | 10 |
| 4 | $SiH_4/He = 1$<br>$SiF_4/He = 1$<br>$B_2H_6/He = 1 \times 10^{-2}$<br>NO | $SiH_4 + SiF_4 = 100$ | $SiH_4/SiF_4 = 8/2$<br>$B_2H_6/(SiH_4 + SiF_4) = 2 \times 10^{-5}$<br>$NO/(SiH_4 + SiF_4) = 3 \times 10^{-2}$ | 15 |

EXAMPLE 23

Image forming members for electrophotography were prepared by following the same conditions and procedures as in Examples 19 and 20, respectively, except that the conditions for preparation of the amorphous layer (II) were changed to the respective conditions as shown in Table 6D below.

The image forming members thus obtained were set in a charging-exposure-developing device, subjected to corona charging at ⊖5 kV for 0.2 sec, followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was subjected once to cleaning with a rubber blade, and the above image making-cleaning step was repeated again. Even after a repetition number of 100,000 or more, no deterioration of image was observed in any of the image forming members for electrophotography.

TABLE 6D

| Conditions | Gases employed | Flow rate (SCCM) | Flow rate ratio | Discharging power ($W/cm^2$) | Layer thickness |
|---|---|---|---|---|---|
| 1 | $SiH_4/He = 0.5$<br>$SiF_4/He = 0.5$<br>$C_2H_4$ | $SiH_4 + SiF_4 = 15$ | $SiH_4:SiF_4:C_2H_4 = 0.3:0.1:9.6$ | 0.18 | 0.3μ |
| 2 | $SiH_4/He = 0.5$<br>$SiF_4/He = 0.5$<br>$C_2H_4$ | $SiH_4 + SiF_4 = 150$ | $SiH_4:SiF_4:C_2H_4 = 3:3:4$ | 0.18 | 1.5μ |

EXAMPLE 24

Image forming members (Sample No. D 601–D 649) were prepared according to the same method as in case of Sample Nos. D 102, D 104, D 105, D 106, D 109, D 113 and D 114, respectively, in Example 19, except that the content ratio of silicon atoms to carbon atoms was varied in the amorphous layer (II) by varying the flow rate ratio of $SiH_4$ gas:$SiF_4$ gas:$C_2H_4$ gas during formation of the amorphous layer (II). For each of the thus prepared image forming members, the steps of image making, development and cleaning as described in Example 19 were repeated for about 50,000 times, followed by image evaluation, to obtain the results as shown in Table 7D.

TABLE 7D

| Sample No. | D 601 | D 602 | D 603 | D 604 | D 605 | D 606 | D 607 | D 608 |
|---|---|---|---|---|---|---|---|---|
| $SiH_4:SiF_4:C_2H_4$ | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (Content ratio) | 9:1 | 7:3 | 5.5:4.5 | 4:6 | 3:7 | 3:8 | 1.2:8.8 | 0.8:9.2 |
| Image quality evalu- | Δ | ○ | ◎ | ◎ | ◎ | ○ | Δ | X |

TABLE 7D-continued

| Sample No. | D 601 | D 602 | D 603 | D 604 | D 605 | D 606 | D 607 | D 608 |
|---|---|---|---|---|---|---|---|---|
| ation | | | | | | | | |

◎ : Very good
○: Good
Δ: Practically satisfactory
X: Image defect slightly formed

EXAMPLE 25

The respective image forming members (Sample No. D 701–D 704) were prepared according to the same method as in preparation of the Sample No. D 103 in Example 19, except that the layer thickness of the amorphous layer (II) was varied. For each sample, the steps of image-making, development and cleaning as described in Example 19 were repeated to obtain the results shown below.

TABLE 8D

| Sample No. | Thickness of amorphous layer (II) (μ) | Results |
|---|---|---|
| D 701 | 0.001 | Image defect liable to occur. |
| D 702 | 0.02 | No image defect during 20,000 repetitions. |
| D 703 | 0.05 | Stable for 50,000 repitions or more. |
| D 704 | 1 | Stable for 200,000 repetitions or more. |

What is claimed is:

1. A photoconductive member comprising a support for photoconductive member and an amorphous layer comprising an amorphous material containing silicon atoms as a matrix and containing hydrogen atoms or halogen atoms as a constituent and exhibiting photoconductivity, said amorphous layer having a first layer region containing, as constituent atoms, oxygen atoms and a second layer region containing, as constituent atoms, the atoms belonging to the group V of the periodic table in a distribution which is continuous in the direction of the layer thickness and more enriched toward the side of said support.

2. A photoconductive member according to claim 1, wherein the first layer region occupies the whole layer region of the amorphous layer.

3. A photoconductive member according to claim 1, wherein the second layer region is provided at the end portion layer region on the support side as a part of the amorphous layer.

4. A photoconductive member according to claim 3, wherein there is provided a third layer region containing no atom belonging to the group V of the periodic table on the second layer region.

5. A photoconductive member according to claim 4, wherein the third layer region contains a substance for controlling the conduction characteristics.

6. A photoconductive member according to claim 5, wherein the substance for controlling the conduction characteristics is an atom belonging to the group III of the periodic table.

7. A photoconductive member according to claim 5, wherein the substance for controlling the conduction characteristics is a p-type impurity.

8. A photoconductive member according to claim 3, wherein the second layer region has a thickness of 30 Å to 5μ.

9. A photoconductive member according to claim 3, wherein the second layer region has the maximum distribution concentration value Cmax of the contents of the atoms belonging to the group V of the periodic table within 5μ in the direction of the layer thickness from the support side.

10. A photoconductive member according to claim 9, wherein the Cmax is 100 atomic ppm or more based on silicon atoms.

11. A photoconductive member according to claim 1, wherein the content of oxygen atoms in the first layer region is 0.001 to 30 atomic %.

12. A photoconductive member according to claim 1, wherein the content of the atoms belonging to the group V of the periodic table in the second layer region is 30 to $5\times10^4$ atomic ppm.

13. A photoconductive member according to claim 1, wherein the second layer region has a thickness of 30 Å to 5μ.

14. A photoconductive member according to claim 1, wherein the amorphous layer has a thickness of 1 to 100μ.

15. A photoconductive member according to claim 1, wherein hydrogen atoms are contained in the amorphous layer.

16. A photoconductive member according to claim 15, wherein the content of hydrogen atoms in the amorphous layer is 1 to 40 atomic %.

17. A photoconductive member according to claim 1, wherein halogen atoms are contained in the amorphous layer.

18. A photoconductive member according to claim 17, wherein the content of halogen atoms in the amorphous layer is 1 to 40 atomic %.

19. A photoconductive member according to claim 1, wherein both of hydrogen atoms and halogen atoms are contained in the amorphous layer.

20. A photoconductive member according to claim 19, wherein the total content of hydrogen atoms and hajogen atoms is 1 to 40 atomic %.

21. A photoconductive member comprising a support for photoconductive member, a first amorphous layer comprising an amorphous material containing silicon atoms as a matrix and containing hydrogen atoms or halogen atoms as a constituent and exhibiting photoconductivity, and a second amorphous layer comprising an amorphous material containing silicon atoms and carbon atoms, said first amorphous layer having a first layer region containing, as constituent atoms, oxygen atoms and a second layer region containing, as constituent atoms, the atoms belonging to the group V of the periodic table in a distribution which is continuous in the direction of the layer thickness and more enriched toward the side of said support.

22. A photoconductive member according to claim 21, wherein the first layer region occupies the whole layer region of the amorphous layer.

23. A photoconductive member according to claim 21, wherein the second layer region is provided at the end portion layer region on the support side as a part of the amorphous layer.

24. A photoconductive member according to claim 23, wherein there is provided a third layer region containing no atom belonging to the group V of the periodic table on the second layer region.

25. A photoconductive member according to claim 24, wherein the third layer region contains a substance for controlling the conduction characteristics.

26. A photoconductive member according to claim 25, wherein the substance for controlling the conduction characteristics is an atom belonging to the group III of the periodic table.

27. A photoconductive member according to claim 25, wherein the substance for controlling the conduction characteristics is a p-type impurity.

28. A photoconductive member according to claim 23, wherein the second layer region has a thickness of 30 Å to 5μ.

29. A photoconductive member according to claim 23, wherein the second layer region has the maximum distribution concentration value Cmax of the contents of the atoms belonging to the group V of the periodic table within 5μ in the direction of the layer thickness from the support side.

30. A photoconductive member according to claim 29, wherein the Cmax is 100 atomic ppm or more based on silicon atoms.

31. A photoconductive member according to claim 21, wherein the content of oxygen atoms in the first layer region is 0.001 to 30 atomic %.

32. A photoconductive member according to claim 21, wherein the content of the atoms belonging to the group V of the periodic table in the second layer region is 30 to $5\times10^4$ atomic ppm.

33. A photoconductive member according to claim 21, wherein the second layer region has a thickness of 30 Å to 5μ.

34. A photoconductive member according to claim 21, wherein the amorphous layer has a thickness of 1 to 100μ.

35. A photoconductive member according to claim 21, wherein hydrogen atoms are contained in the amorphous layer.

36. A photoconductive member according to claim 35, wherein the content of hydrogen atoms in the amorphous layer is 1 to 40 atomic %.

37. A photoconductive member according to claim 21, wherein halogen atoms are contained in the amorphous layer.

38. A photoconductive member according to claim 37, wherein the content of halogen atoms is 1 to 40 atomic %.

39. A photoconductive member according to claim 21, wherein both of hydrogen atoms and halogen atoms are contained in the amorphous layer.

40. A photoconductive member according to claim 39, wherein the total content of hydrogen atoms and halogen atoms is 1 to 40 atomic %.

41. A photoconductive member according to claim 21, wherein the amorphous material containing carbon atoms further contains hydrogen atoms.

42. A photoconductive member according to claim 21, wherein the amorphous material containing carbon atoms further contains halogen atoms.

43. A photoconductive member according to claim 21, wherein the amorphous material containing carbon atoms further contains both of hydrogen atoms and halogen atoms.

44. A photoconductive member according to claim 21, wherein the second amorphous layer has a thickness of 0.003 to 30μ.

45. A photoconductive member according to claim 21, wherein the amorphous material containing carbon atoms is a member of the group consisting of general formula (1); general formula (2); or general formula (3); wherein (1), (2) and (3) are as follows:

(1) $a\text{-}Si_aC_{1-a}$ wherein $0.1 \leqq a \leqq 0.99999$, (2) $a\text{-}(Si_bC_{1-b})_cH_{1-c}$ wherein
$0.1 \leqq b \leqq 0.99999$ and
$0.6 \leqq c \leqq 0.99$, and (3) $a\text{-}(Si_dD_{1-d})_e(X,H)_{1-e}$ wherein
$0.1 \leqq d \leqq 0.99999$ and
$0.8 \leqq e \leqq 0.99$.

* * * * *

UNITED STATES PATENT AND TRADEMARK OFFICE

CERTIFICATE OF CORRECTION

PATENT NO. : 4,490,454

DATED : December 25, 1984

INVENTOR(S) : TERUO MISUMI, ET AL.

It is certified that error appears in the above-identified patent and that said Letters Patent is hereby corrected as shown below:

Column 6, line 55, change "$T_b$" to --$T_B$--

Column 7, lines 42 and 43, change "inerhalogen" to --interhalogen--

Column 9, line 15, change "resion" to --region--

Column 13, line 52, after "preferably" insert --be--

Column 28, line 33, Table 1C, last line change "Torr" to --0.2 Torr--

Column 40, line 45, Claim 45, change "$(3)a-(Si_dD_{1-d})e(X,H)1-e$" to --$(3)a-(Si_dC_{1-d})e(X,H)1-e$--

Signed and Sealed this

*Seventeenth* Day of *December 1985*

[SEAL]

*Attest:*

DONALD J. QUIGG

*Attesting Officer*

*Commissioner of Patents and Trademarks*